US005577409A

United States Patent [19]

Oyabu et al.

[11] Patent Number: 5,577,409

[45] Date of Patent: Nov. 26, 1996

[54] CYLINDER LOCK

[75] Inventors: Yoshinobu Oyabu; Shozo Kito, both of Aichi, Japan

[73] Assignee: Kabushiki Kaisha Tokai Rika Denki Seisakusho, Aichi, Japan

[21] Appl. No.: 348,830

[22] Filed: Nov. 29, 1994

[30] Foreign Application Priority Data

| | | | |
|---|---|---|---|
| Nov. 30, 1993 | [JP] | Japan | 5-299965 |
| Apr. 22, 1994 | [JP] | Japan | 6-084524 |
| Oct. 25, 1994 | [JP] | Japan | 6-260252 |

[51] Int. Cl.[6] ..... E05B 9/10

[52] U.S. Cl. ..... 70/379 R; 70/422

[58] Field of Search ..... 70/379 R, 422, 70/375, 379 A, 380, 188–189, 218, 221–222

[56] References Cited

U.S. PATENT DOCUMENTS

| | | | |
|---|---|---|---|
| 3,410,123 | 11/1968 | Jacobi . | |
| 3,992,907 | 11/1976 | Pilvet | 70/222 |
| 4,903,512 | 2/1990 | Leroy | 70/380 |
| 4,936,895 | 6/1990 | Leclerc | 70/422 |
| 5,044,183 | 9/1991 | Neyret | 70/380 |
| 5,070,716 | 12/1991 | Whorlow | 70/380 |
| 5,263,348 | 11/1993 | Wittwer | 70/422 |
| 5,265,453 | 11/1993 | Konii | 70/380 |

FOREIGN PATENT DOCUMENTS

| | | |
|---|---|---|
| 0341132 | 8/1989 | European Pat. Off. . |
| 0444972 | 4/1991 | European Pat. Off. . |
| 2583813 | 12/1986 | France . |

*Primary Examiner*—Steven N. Meyers
*Assistant Examiner*—Gary Estremsky
*Attorney, Agent, or Firm*—Finnegan, Henderson, Farabow, Garrett & Dunner, L.L.P.

[57] ABSTRACT

When a key other than a regular key or the like is inserted to forcibly rotate a key rotor, a coupling member is moved in a direction indicated by an arrow by an uncoupling mechanism. This movement uncouples a rear rotor from the coupling member. As a result, the key rotor and a sleeve only rotate idly, and the rear rotor and a lock lever are not rotated. Hence, a cylinder lock is not unlocked, and no damaging force is never applied to components of the cylinder lock such as tumblers.

4 Claims, 18 Drawing Sheets

CYLINDER LOCK

BACKGROUND OF THE INVENTION

1. Field of the Invention

The invention relates to cylinder locks designed to prohibit wrongful unlocking.

2. Related Art

A cylinder lock arranged on a door of an automobile is designed as follows. A plurality of tumblers are arranged so as to be movable in radial directions in a key rotor that is rotatably arranged in a rotor case, and such plurality of tumblers are urged by springs in a single direction. As the rotation of the key rotor is blocked with end portions of the tumblers engaged with tumbler engagement grooves arranged in inner circumferential portions while inserted thereinto, the cylinder lock can be locked.

To unlock the cylinder lock, a regular key is inserted into a keyhole of the key rotor. As a result, the respective tumblers are moved so as to be released from the tumbler engagement grooves by the key. As the key is rotated, the key rotor is rotated, which causes the lock lever to rotate and hence unlocks the cylinder lock.

In the cylinder lock of this type when a key other than the regular key, a screwdriver, or the like is inserted into the keyhole of the key rotor to forcibly rotate the key rotor, the end portions of the tumblers are forcibly biased onto the tumbler engagement grooves of the rotor case, which in turn breaks either the tumblers or the rotor case. As a result, the cylinder lock is no longer used again.

By the way, it is conceivable to improve the strength of the respective components of the cylinder lock. However, this requires that the thicknesses of the components be increased, which in turn imposes the problem of increasing the size of the cylinder lock as a whole.

SUMMARY OF THE INVENTION

The invention has been made in consideration of the aforementioned circumstances, and an object of the invention is therefore to provide a cylinder lock which not only is not unlocked, but also is used again by allowing no damaging force to be applied to components thereof such as tumblers so that the components will never be broken even if a key other than the regular key, a screwdriver, or the like is inserted into the keyhole of the key rotor to rotate the key rotor.

To achieve the above object, a cylinder lock according to the present invention includes: a rotor case being cylindrical in shape and fixedly arranged; a sleeve being rotatably arranged inside the rotor case and having tumbler engagement grooves formed therein; a key rotor being rotatably arranged inside the sleeve and having an axially extending keyhole and radially extending tumbler setting grooves formed thereon; tumblers being movably arranged in the tumbler setting grooves of the key rotor, being engageable with the sleeve with ends thereof being held while inserted into the tumbler engagement grooves by spring members before a key is inserted, and being released from the tumbler engagement grooves by insertion of a regular key; a rear rotor being rotatably arranged so as to confront the key rotor in an axial direction; a lock lever being arranged so as to be rotatable integrally with the rear rotor; a key rotor side coupling portion being formed at a portion confronting the rear rotor in the key rotor; a rear rotor side coupling portion being formed at a portion confronting the key rotor in the rear rotor; a coupling member being arranged so as to be movable in radial directions so as to bridge between the key rotor side coupling portion and the rear rotor side coupling portion, being selectively set to an engagement position and to a disengagement position, and allowing the key rotor and the rear rotor to be rotatable integrally with each other in the engagement position before the key is inserted, the engagement position being a position at which the coupling member is engaged with the key rotor side coupling portion and the rear rotor side coupling portion in a rotational direction by movement thereof, the disengagement position being a position at which the engagement of the coupling member is released to thereby make the key rotor to be freely rotatable independently of the rear rotor; and an uncoupling mechanism having a moving element arranged in the rotor case so as to be movable in the radial directions by rotation of the sleeve, and causing the coupling member to move to the disengagement position by movement of the moving element.

To achieve a similar object, a cylinder lock according to the present invention includes: a rotor case being cylindrical in shape and fixedly arranged; a sleeve being rotatably arranged inside the rotor case and having tumbler engagement grooves formed therein; a key rotor being rotatably arranged inside the sleeve and having an axially extending keyhole and radially extending tumbler setting grooves formed thereon; tumblers being movably arranged in the tumbler setting grooves of the key rotor, being engageable with the sleeve with ends thereof being held while inserted into the tumbler engagement grooves by spring members before a key is inserted, and being released from the tumbler engagement grooves by insertion of a regular key; a lock lever being arranged in a rear portion of the key rotor so as to be movable in radial directions between an engagement position at which the lock lever is engaged with the key rotor and a disengagement position at which the lock lever is disengaged from the key rotor, and being rotatable integrally with the key rotor in the engagement position; a moving member being arranged so as to be movable in the radial directions between a coupling position and an uncoupling position while bridging between the sleeve and the rotor case, causing the lock lever to set to the engagement position while allowing the lock lever to rotate when the moving member is in the coupling position, and causing the lock lever to move to the disengagement position while regulating the rotation of the lock lever when the moving member is in the uncoupling position, so that the key rotor can be freely rotatable independently of the lock lever; and a cam portion being arranged in the sleeve, causing the moving member to set to the coupling position before the key is inserted, and causing the moving member to move to the uncoupling position as the sleeve is being rotated.

To achieve a similar object, a cylinder lock according to the present invention includes: a rotor case being cylindrical in shape and fixedly arranged; a sleeve being rotatably arranged inside the rotor case and having tumbler engagement grooves formed therein; a key rotor being rotatably arranged inside the sleeve and having an axially extending keyhole and radially extending tumbler setting grooves formed thereon; tumblers being movably arranged in the tumbler setting grooves of the key rotor, being engageable with the sleeve with ends thereof being held while inserted into the tumbler engagement grooves by spring members before a key is inserted, and being released from the tumbler engagement grooves by insertion of a regular key; a lock lever being arranged in a rear portion of the key rotor so as to be movable in radial directions between an engagement position at which the lock lever is engaged with the key rotor and a disengagement position at which the lock lever is disengaged from the key rotor, and being rotatable integrally with the key rotor in the engagement position; a rear rotor being arranged in a rear portion of the key rotor so as to be rotatable integrally with the key rotor, being arranged so as to be movable with respect to the key rotor in the radial directions between a coupling position and an uncoupling position, causing the lock lever to move to the engagement position when the rear rotor is in the coupling position, and causing the lock lever to move to the disengagement position when the rear rotor is in the uncoupling position, so that the key rotor can be made freely rotatable independently of the lock lever and the rear rotor can be rotatable with respect to the lock lever; and a cam portion being arranged in a rear portion of the sleeve, causing the rear rotor to set to the uncoupling position before the key is inserted, and causing the rear rotor to move to the coupling position as the rear rotor is being rotated with respect to the sleeve.

To achieve a similar object, a cylinder lock according to the present invention includes: a rotor case being cylindrical in shape and fixedly arranged; a sleeve being rotatably arranged inside the rotor case and having tumbler engagement grooves formed therein; a key rotor being rotatably arranged inside the sleeve and having an axially extending keyhole and radially extending tumbler setting grooves formed thereon; tumblers being movably arranged in the tumbler setting grooves of the key rotor, being engageable with the sleeve with ends thereof being held while inserted into the tumbler engagement grooves by spring members before a key is inserted, and being released from the tumbler engagement grooves by insertion of a regular key; a lock lever being arranged in a rear portion of the key rotor so as to be rotatable; a coupling member being arranged in the lock lever so as to be movable in radial directions between an engagement position at which the coupling member is engaged with the key rotor and a disengagement position at which the coupling member is disengaged from the key rotor, and being rotatable integrally with the key rotor and the lock lever in the engagement position; a moving member being arranged so as to be movable in the radial directions between a coupling position and an uncoupling position while bridging between the sleeve and the rotor case, causing the coupling member to set to the engagement position while allowing the coupling member to rotate when the moving member is in the coupling position, and causing the coupling member to move to the disengagement position while regulating the rotation of the coupling member when the moving member is in the uncoupling position, so that the key rotor can be freely rotatable independently of the coupling member and the lock lever; and a cam portion being arranged in the sleeve, causing the moving member to set to the coupling position before the key is inserted, and causing the moving member to move to the uncoupling position as the sleeve is being rotated.

The cylinder locks according to present invention preferably includes: a moving block being movably arranged in the sleeve so as to pass through the sleeve in the radial direction and being urged so as to move toward the rotor case by a spring member; an original position engagement recess being arranged in the rotor case, being engageable with the moving block with the sleeve set to an original position before a key is inserted, and having such slopes as to cause the moving block to move toward the key rotor as the sleeve is being rotated from the original position; and an engagement recess being arranged in the key rotor and being engageable with the moving block as the moving block is being moved toward the key rotor.

In the cylinder lock according to the present invention, the tumblers are made engageable with the sleeve in the rotational direction with ends thereof held while inserted into the tumbler engagement grooves by the spring members before a key is inserted. Therefore, under this condition, the key rotor and the sleeve are rotatable integrally with each other. In addition, the key rotor side coupling portion is coupled with the rear rotor side coupling portion by the coupling member. Therefore, the key rotor and the rear rotor are rotatable integrally with each other.

When the regular key is inserted into the keyhole under this pre-insertion condition, the tumblers are moved and thereby released from the tumbler engagement grooves. As a result, the key rotor is made freely rotatable with respect to the sleeve. Therefore, as the inserted key is rotated, the key rotor rotates, but the sleeve does not rotate. Since the sleeve does not rotate, the coupling member is not moved to the disengagement position; i.e., the key rotor and the rear rotor remain coupled with each other. As the key rotor is rotated, the rear rotor and hence the lock lever are rotated, so that the cylinder lock is unlocked.

Further, if a key other than the regular key, a screwdriver, or the like is inserted into the keyhole of the key rotor to forcible rotate the key rotor under the aforementioned pre-insertion condition, then the key rotor and the sleeve are rotated integrally with each other since the tumblers are left inserted into the tumbler engagement grooves. However, the rotation of the sleeve causes the moving element of the uncoupling mechanism to move in the radial direction, and such movement of the moving element causes the coupling member to move to the disengagement position, which in turn uncouples the key rotor from the rear rotor, making the key rotor freely rotatable. As a result, the key rotor and the sleeve rotate integrally with each other, but the rear rotor and hence the lock lever do not rotate, so that the cylinder key cannot be unlocked.

In other words, even if the key rotor is forcibly rotated by the wrong key or the like, the key rotor and the sleeve only rotate idly. Therefore, not only the cylinder lock is not unlocked, but also no damaging force is applied to the components of the cylinder lock, which excludes the possibility of the components being broken and hence allows the cylinder lock to be used again.

In the cylinder lock according to the present invention, the tumblers are made engageable with the sleeve in the rotational direction with the ends thereof held while inserted into the tumbler engagement grooves by the spring members under the pre-insertion condition, in a manner similar to the aforementioned case. Therefore, under this condition, the key rotor and the sleeve are rotatable integrally with each other. In addition, the moving member is set to the coupling position and the lock lever is set to the engagement position so that the lock lever is engaged with the key rotor. Therefore, the key rotor and the lock lever are rotatable integrally with each other.

When the regular key is inserted into the keyhole under this pre-insertion condition, the tumblers are moved and thereby released from the tumbler engagement grooves. As a result, the key rotor is made freely rotatable with respect to the sleeve. Therefore, as the inserted regular key is rotated, the key rotor is rotated with respect to the sleeve, which rotates the lock lever engaged with the key rotor integrally, so that the cylinder lock can be unlocked. Since the sleeve does not rotate at this instance, the moving member remains held in the coupling position.

Further, if a key other than the regular key, a screwdriver, or the like is inserted into the keyhole to forcible rotate the key rotor under the aforementioned pre-insertion condition, then the key rotor and the sleeve are rotated integrally with each other with the tumblers being brought into engagement with the tumbler engagement grooves. However, the rotation of the sleeve causes the moving member to move to the uncoupling position by the cam portion arranged in the sleeve and, in association therewith, the lock lever is moved to the disengagement position, so that the lock lever is disengaged from the key rotor. Therefore, the key rotor and the sleeve rotate integrally with each other, but the lock lever does not rotate, thus not allowing the cylinder key to be unlocked.

In this case also, even if the key rotor is forcibly rotated by the wrong key or the like, the key rotor and the sleeve only rotate idly. Therefore, not only the cylinder lock is not unlocked, but also no damaging force is applied to the components of the cylinder lock, which excludes the possibility of the components being broken and hence allows the cylinder lock to be used again.

In the cylinder lock according to the present invention, the tumblers are made engageable with the sleeve in the rotational direction with the ends thereof held while inserted into the tumbler engagement grooves by the spring members under the pre-insertion condition, in a manner similar to the aforementioned cases. Therefore, under this condition, the key rotor and the sleeve are rotatable integrally with each other. In addition, the rear rotor is set to the uncoupling position and the lock lever is set to the disengagement position. Therefore, the lock lever is disengaged from the key rotor.

When the regular key is inserted into the keyhole under this pre-insertion condition, the tumblers are moved and thereby released from the tumbler engagement grooves. As a result, the key rotor is made freely rotatable with respect to the sleeve. As the inserted regular key is rotated, the key rotor is rotated with respect to the sleeve, which rotates the rear rotor integrally with the key rotor. Then, the rear rotor, while being rotated, is moved to the coupling position by the cam portion arranged in the sleeve and, in association therewith, the lock lever is moved to the engagement position to be engaged with the rear rotor. Therefore, the key rotor and the lock lever are rotated integrally with each other, so that the cylinder lock can be unlocked.

Further, if a key other than the regular key, a screwdriver, or the like is inserted into the keyhole to forcible rotate the key rotor under the aforementioned pre-insertion condition, then the key rotor and the sleeve are rotated integrally with each other with the tumblers being brought into engagement with the tumbler engagement grooves. When the sleeve and the rear rotor are rotated integrally with each other, the rear rotor is held in the disengagement position and the lock lever remains set to the disengagement position since the positional relationship between the sleeve and the rear rotor remains unchanged. Therefore, the key rotor, the sleeve, and the rear rotor rotate integrally with one another, but the lock lever is not rotated, not allowing the cylinder lock to be unlocked.

In this case also, even if the key rotor is forcibly rotated by the wrong key or the like, the key rotor, the sleeve, and the rear rotor only rotate idly. Therefore, not only the cylinder lock is not unlocked, but also no damaging force is applied to the components of the cylinder lock, which excludes the possibility of the components being broken and hence allows the cylinder lock to be used again.

In the cylinder lock according to the present invention, the tumblers are made engageable with the sleeve in the rotational direction with the ends thereof held while inserted into the tumbler engagement grooves by the spring members under the pre-insertion condition, in a manner similar to the aforementioned cases. Therefore, under this condition, the key rotor and the sleeve are rotatable integrally with each other. In addition, the moving member is set to the coupling position and the coupling member is set to the engagement position, so that the key rotor is engaged with the lock lever through the coupling member. Hence, the key rotor and the lock lever are rotatable integrally with each other.

When the regular key is inserted into the keyhole under this pre-insertion condition, the tumblers are moved and thereby released from the tumbler engagement grooves. As a result, the key rotor is made freely rotatable with respect to the sleeve. Therefore, as the inserted regular key is rotated, the key rotor is rotated with respect to the sleeve, which causes the lock lever engaged with the key rotor through the coupling member to be rotated integrally with the key rotor, so that the cylinder lock can be unlocked. Since the sleeve does not rotate at this instance, the moving member remains held in the coupling position.

Further, if a key other than the regular key, a screwdriver, or the like is inserted into the keyhole to forcible rotate the key rotor under the aforementioned pre-insertion condition, then the key rotor and the sleeve are rotated integrally with each other with the tumblers being brought into engagement with the tumbler engagement grooves. However, when the sleeve is rotated, the moving member is moved to the uncoupling position by the cam portion arranged in the sleeve and, in association therewith, the coupling member is moved to the disengagement position, thus disengaging the key rotor from the lock lever. Therefore, the key rotor and the sleeve rotate integrally with each other, but the coupling member and the lock lever do not rotate, so that the cylinder lock cannot be unlocked.

In this case also, even if the key rotor is forcibly rotated by the wrong key or the like, the key rotor and the sleeve rotate only loosely. Therefore, not only the cylinder lock is not unlocked, but also no damaging force is applied to the components of the cylinder lock, which excludes the possibility of the components being broken and hence allows the cylinder lock to be used again.

In the cylinder lock according to the present invention, the moving block is engaged with the sleeve and the rotor case so as to bridge between the sleeve and the rotor case while brought into engagement with the original position engagement recess of the rotor case before a key is inserted as well as when the regular key is inserted and rotated. This engagement of the moving block with the sleeve and the rotor case holds the sleeve in the original position.

On the other hand, if a key other than the regular key, a screwdriver, or the like is inserted to forcibly rotate the key rotor, then the moving block moves toward the key rotor to be engaged with the engagement recess in the key rotor in association with the rotation of the sleeve, which in turn engages the moving block with the sleeve and the key rotor so as to bridge between the sleeve and the key rotor. As a result, the sleeve and the key rotor rotate integrally with each other.

When the sleeve and the key rotor are returned to the original position, the moving block is moved so as to be engaged with the original position engagement recess of the rotor case, so that the moving block is engaged with the sleeve and the rotor case while bridging between the sleeve and the rotor case. The engagement of the moving block with the sleeve and the rotor case causes the sleeve to be held in the original position. Therefore, the original position of the sleeve and the key rotor can be identified.

BRIEF DESCRIPTION OF THE DRAWINGS

FIG. 9 is a view equivalent to FIG. 1 with a key rotor forcibly rotated by a wrong key or the like;

FIG. 23 is a view equivalent to FIG. 11 with the key rotor forcibly rotated with a wrong key or the like;

FIG. 43 is a view equivalent to FIG. 38 with the key rotor forcibly rotated by a wrong key or the like;

DETAILED DESCRIPTION OF THE PREFERRED EMBODIMENTS

First Embodiment

Figure 1:
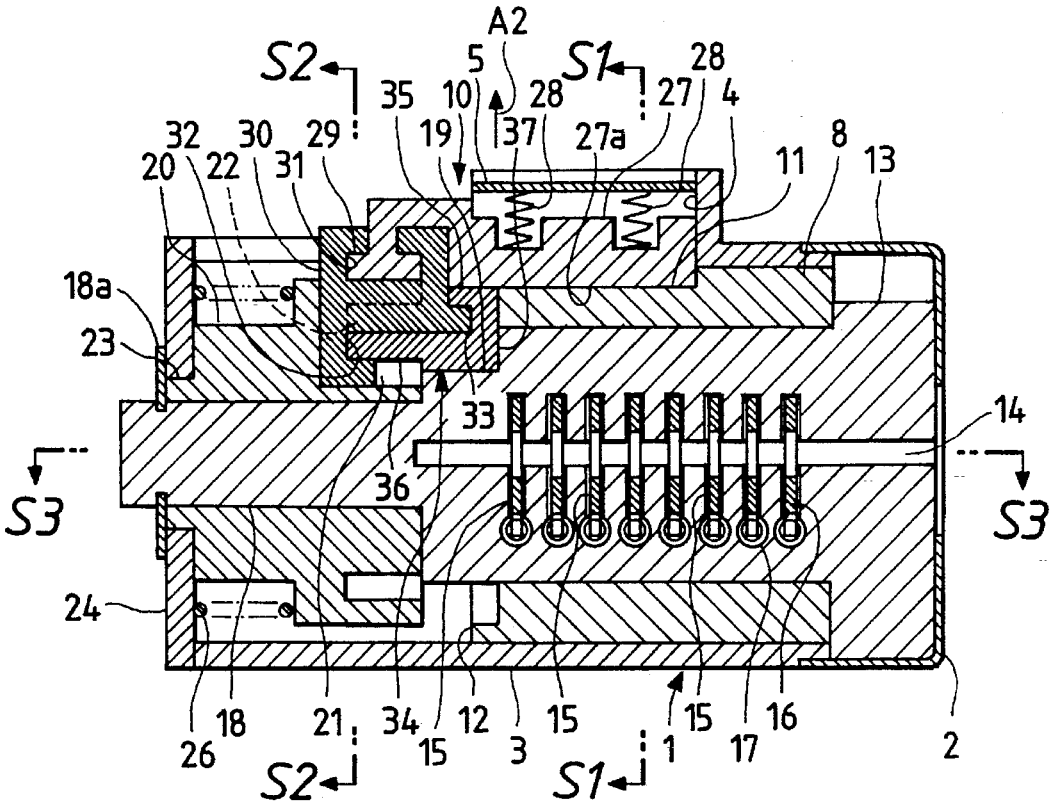
FIG. 1 is a longitudinal sectional side view showing a first embodiment of the invention.
Figure 5:
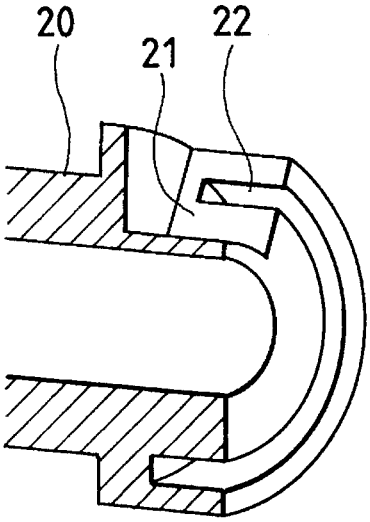
FIG. 5 is a cutaway perspective view of a rear rotor side coupling portion.
Figure 6:
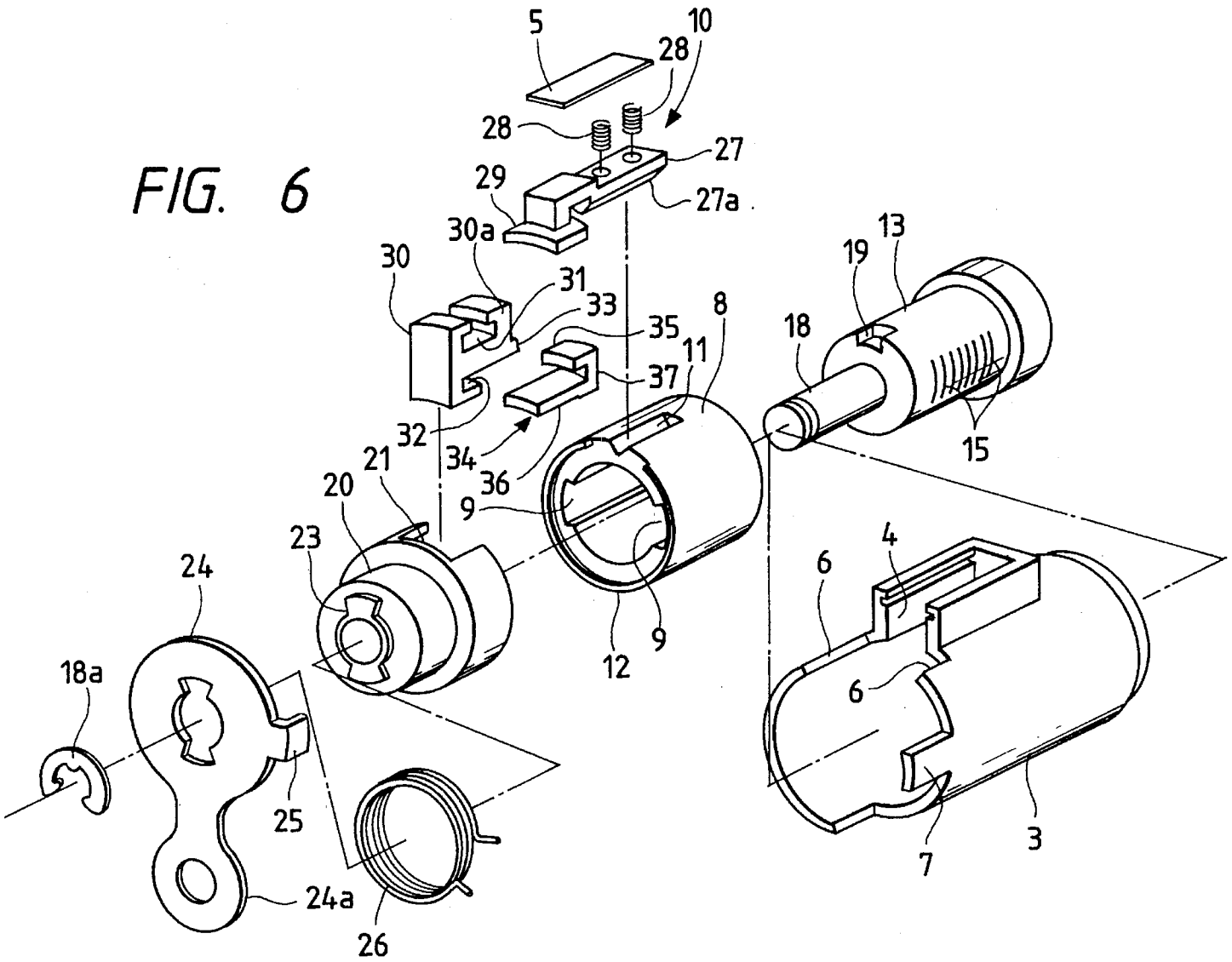
FIG. 6 is an exploded perspective view.
Figure 8:
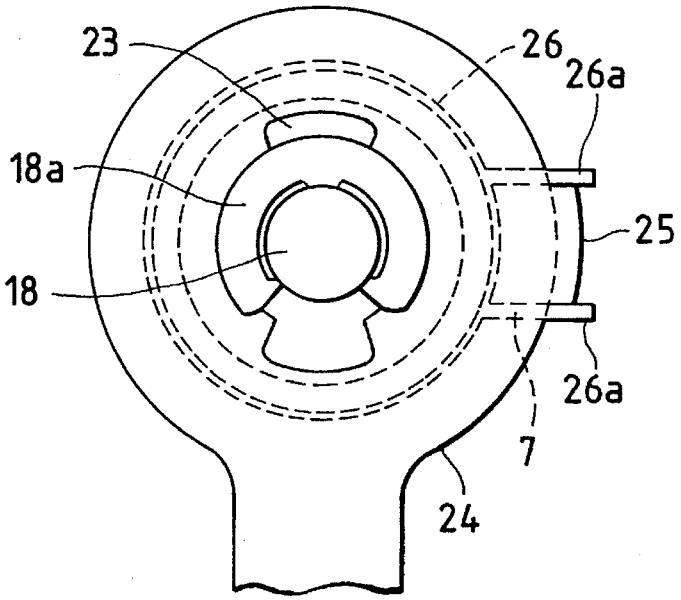
FIG. 8 is a rear view.
Figure 9:
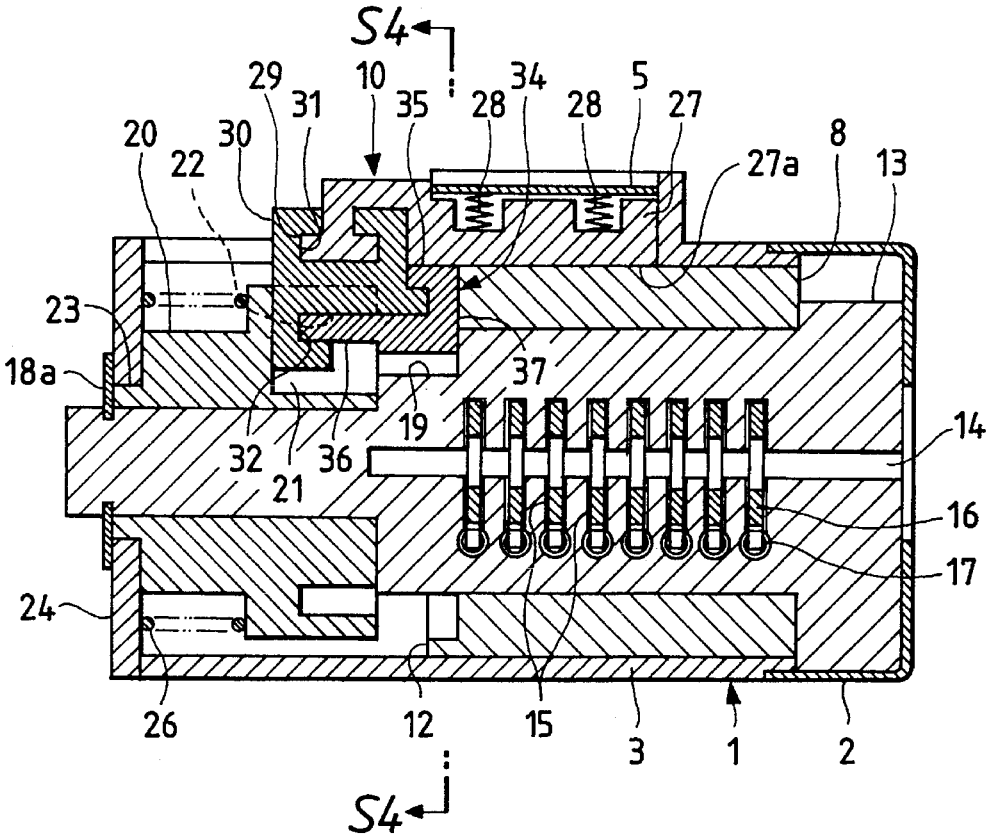
Figure 10:
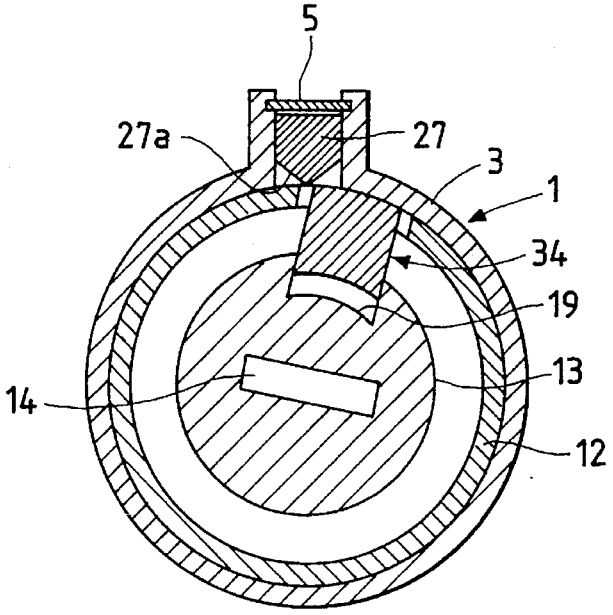
FIG. 10 is a sectional view taken along a line S4—S4 in FIG. 9.

A cylinder lock, which is a first embodiment of the invention, will now be described with reference to FIGS. 1 to 10. FIG. 1 shows a condition before a key is inserted; FIG. 6 shows the components in exploded form; and FIG. 9 shows a condition in which a key rotor is forcibly rotated by a wrong key or the like. Referring first to FIG. 1 and FIGS. 2 to 5 and FIG. 6 which are related to FIG. 1, the cylinder lock, which is the first embodiment, will be described. A rotor case 1 is formed into a substantially cylindrical member by coupling a cap portion 2 with a case main body 3 in an axial direction (the right side as viewed in FIG. 1 is referred to as the front side). On an upper portion of the case main body 3 is a moving element setting groove 4, and a spring hold plate 5 is arranged on an upper portion of the groove 4. In a rear portion of the case main body 3 are retaining portions 6, 6 as well as a spring stopper portion as shown in FIG. 6.

Figure 2:
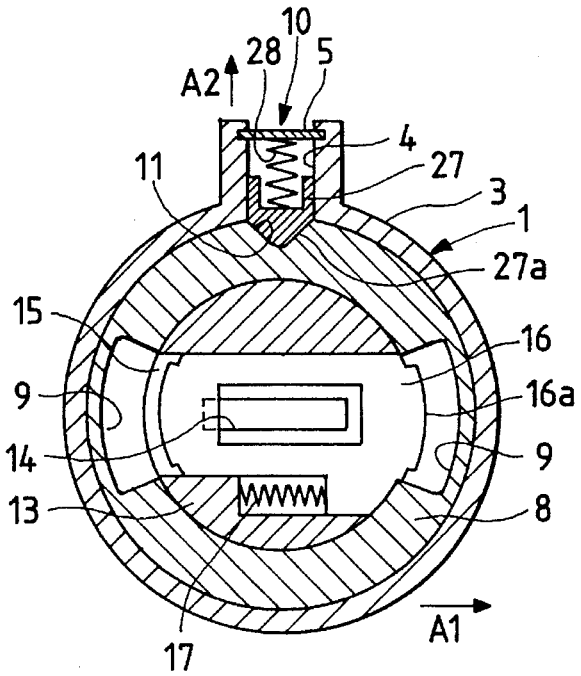
FIG. 2 is a sectional view taken along a line S1—S1 in FIG. 1.
Figure 3:
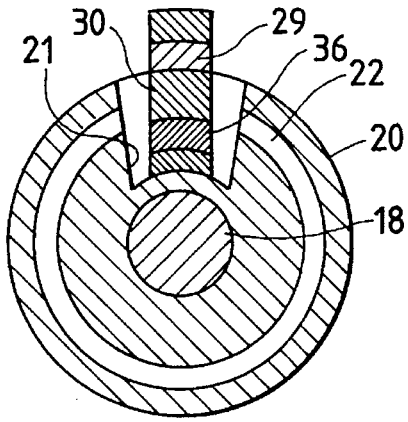
FIG. 3 is a partially sectional view taken along a line S2—S2 in FIG. 1.
Figure 4:
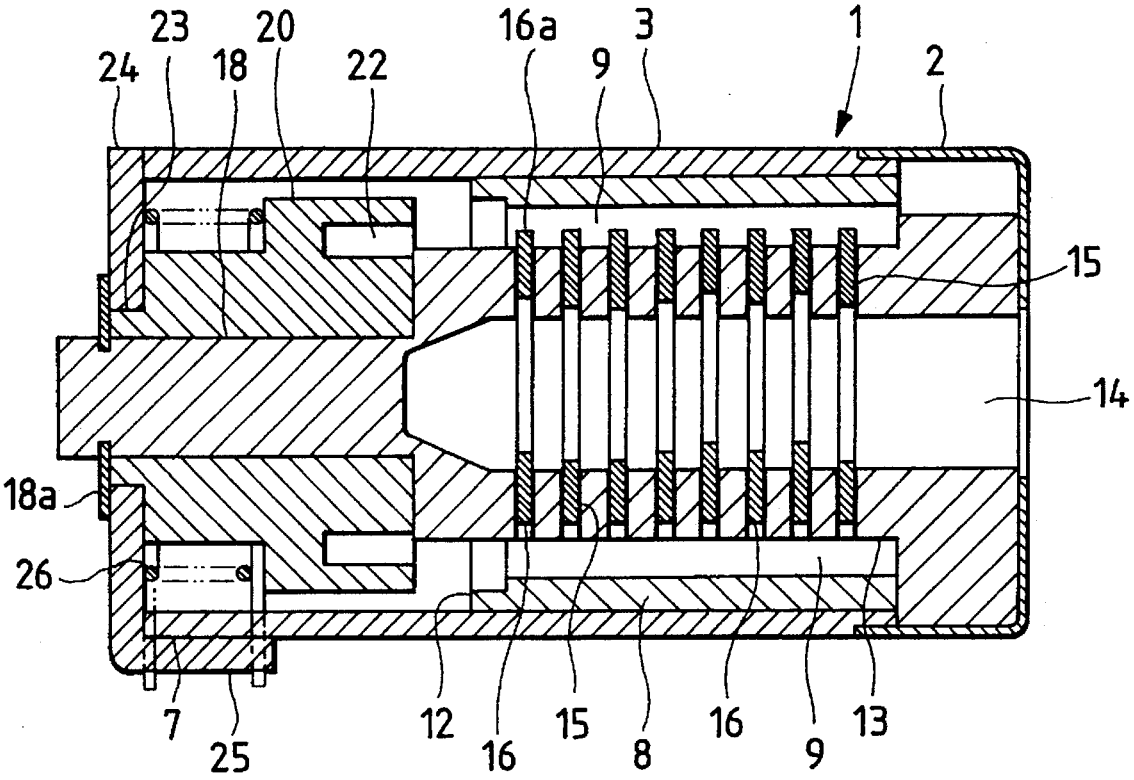
FIG. 4 is a sectional view taken along a line S3—S3 in FIG. 1.

A substantially cylindrical sleeve 8 is rotatably arranged inside the rotor case 1. As shown in FIG. 2, tumbler engagement grooves 9, 9 are formed on the inner surface of the sleeve 8, and a recessed cam portion 11 is formed on the outer surface thereof. The cam portion 11 constitutes a part of an uncoupling mechanism 10, which will be described later. In addition, a collar portion 12 that is opened at the cam portion 11 is formed at the rear end of the sleeve 8.

A substantially shaft-like key rotor 13 is rotatably arranged inside the sleeve 8. A keyhole 14 runs through the key rotor 13 in the axial direction, and a plurality of tumbler setting grooves 15 are arranged in the key rotor 13 in the radial direction. Tumblers 16 are movably set in the respective tumbler setting grooves 15. Each tumbler 16 is urged so as to move in a direction indicated by an arrow A1 in FIG. 2 by a corresponding spring member 17, with an end portion 16*a* thereof being held while inserted into one of the tumbler engagement grooves 9, 9. As a result of the construction, the tumblers can be engaged with the sleeve 8 in a direction of rotation. It should be noted that each tumbler 16 is designed to be disengaged from the tumbler engagement groove 9 by being moved in a direction opposite to the arrow A1 upon insertion of a key (regular key) into the keyhole 14 (see FIG. 7).

Further, a support shaft portion 18 is formed from the intermediate portion toward the rear portion of the key rotor 13. A recessed key rotor side coupling portion 19 is formed in a stepped portion of the intermediate portion.

In the support shaft portion 18 a rear rotor 20 is rotatably fitted into the key rotor 13 so as to confront each other in the axial direction. As shown in FIG. 5, a recessed rear rotor side coupling portion 21 is formed on the rear rotor 20, and a release portion 22, which is an annular slit that is opened at both wall surfaces of the rear rotor side coupling portion 21, is also formed. In addition, a lever fitting protuberance 23 is arranged at the rear end of the rear rotor 20.

A lock lever 24 is fitted into and coupled with this lever fitting protuberance 23. The lock lever 24 has not only a positioning portion 25 but also a coupling portion 24*a* that is coupled with, e.g., a door lock mechanism. The lock lever 24 and hence the key rotor 13 are designed to be held in a predetermined angular position by a torsion spring 26. That is, as shown in FIG. 8, with the positioning portion 25 of the lock lever 24 and the spring hold plate 7 of the case main body 3 being aligned, the torsion spring 26 is squeezed in to cause both ends 26*a*, 26*a* of the torsion spring 26 to be retained by both sides of the positioning portion 25 and the spring hold plate 7. The lock lever 24 is made unreleasable by an E ring 18*a* attached to an end portion of the support shaft portion 18.

By the way, the uncoupling mechanism 10 is constructed in the following manner. A moving element 27 is set in the moving element setting groove 4 so as to be movable in the radial directions (up and down). A projected fitting portion 27*a* that is fitted into the cam portion 11 is formed on the lower surface of the moving element 27. This moving element 27 is urged by springs 28 in such a direction as to be fitted into the cam portion 11. The moving element 27 is designed to move in a direction indicated by an arrow A2 in FIGS. 1 and 2 upon rotation of the sleeve 8. A support piece 29 is formed in the rear of the moving element 27. The support piece 29 is an arc subtending the center of the key rotor 13.

Further, an intermediate block 30 is disposed on the rear rotor side coupling portion 21 so as to be movable in both radial and rotational directions. A holding groove 31 is formed in an upper portion of the intermediate block 30. The holding groove 31 retains the support piece 29 in the radial direction and allows the support piece 29 to move in the rotational direction. In both lower and front portions of the intermediate block 30 are a coupling member holding recess 32 and a coupling member holding projection 33, respectively.

On the other hand, a coupling member 34 whose movement is controlled by the uncoupling mechanism 10 is arranged so as to be movable in the radial directions while bridging between the key rotor side coupling portion 19 and the rear rotor side coupling portion 21. That is, the coupling member 34 is substantially C-shaped with an arcuate upper piece 35 and an arcuate lower piece 36 coupled through an intermediate portion 37. The intermediate portion 37 is fitted with the key rotor side coupling portion 19, and the upper piece 35 and the lower piece 36 are fitted into the coupling member holding projection 33 and the coupling member holding recess 32 of the intermediate block 30 within the rear rotor side coupling portion 21, respectively.

Under the conditions shown in FIGS. 1 and 2, the lower piece 36 of the coupling member 34 confronts both wall surfaces of the rear rotor side coupling portion 21 in the rotational direction and does not confront the release portion 22, so that the coupling member 34 is so positioned as to be engageable with the respective coupling portions 19, 21 in the rotational direction. Further, under the condition shown in FIG. 9, the lower piece 36 of the coupling member 34 confronts the release portion 22 in the rotational direction in the rear rotor side coupling portion 21. That is, the lower piece 36 is disengaged, so that the key rotor 13 is in such a release position as to be freely rotatable independently of the rear rotor 20.

A mode of operation of the aforementioned construction will be described next. As shown in FIGS. 1 to 4, the respective tumblers 16 are engageable in the rotational direction with the sleeve 8 while held with the end portions 16*a* thereof inserted into the tumbler engagement groove 9 by the corresponding spring members 17 before the key is inserted. Therefore, under this condition, the key rotor 13 is rotatable integrally with the sleeve 8. Further, the key rotor side coupling portion 19 is ready to be coupled with the rear rotor side coupling portion 21 through the coupling member 34. Therefore, the key rotor 13 is rotatable integrally with the rear rotor 20.

Figure 7:
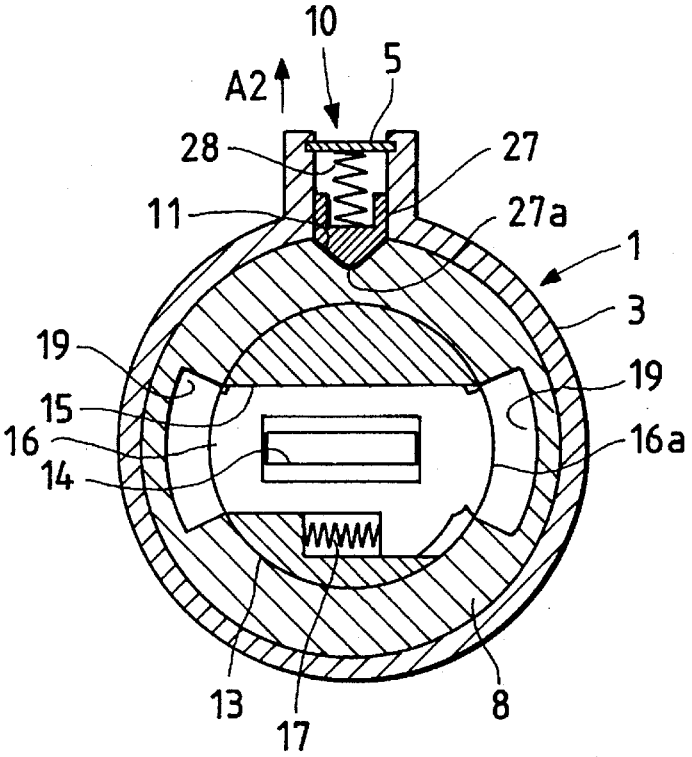
FIG. 7 is a view equivalent to FIG. 2 with a regular key inserted.

When a regular key is inserted into the keyhole 14 under this pre-insertion condition, the ends 16*a* of the respective tumblers 16 move to be released from the tumbler engagement groove 9 as shown in FIG. 7. As a result, the key rotor 13 is freely rotatable with respect to the sleeve 8. Therefore, as the inserted key is rotated, the key rotor 13 rotates, whereas the sleeve 8 does not rotate. With the sleeve 8 not rotating, the moving element 27 of the uncoupling mechanism 10 is not moved in the radial direction (in the direction indicated by the arrow A2 in FIGS. 1, 2, and 7). That is, the coupling member 34 does not move to the uncoupling position, thus leaving the key rotor 13 and the rear rotor 20 coupled. As the key rotor 13 rotates, so do the rear rotor 20 and hence the lock lever 24, which in turn unlocks the cylinder lock. It should be noted that when the rotating force applied to the key is removed, the spring force of the torsion spring 26 causes the rear rotor 20 and the key rotor 13 to return to the original positions thereof.

Further, when a key other than the regular key, a screwdriver, or the like is inserted into the keyhole 14 in the key rotor 13 to rotate the key rotor 13 forcibly under the aforementioned pre-insertion condition, the key rotor 13 rotates integrally with the sleeve 8 because the respective tumblers 16 are left inserted into the tumbler engagement groove 9.

However, the rotation of the sleeve 8 causes the moving element 27 of the uncoupling mechanism 10 to move in the radial direction (in the direction indicated by the arrow A2) along the slopes of the cam portion 11. This movement, in turn, causes the coupling member 34 to move to the uncoupling position shown in FIGS. 9 and 10 (the position raised in the direction of the arrow A2), so that the lower piece 36 of the coupling member 34 confronts the release portion 22 and, as a result, the coupling member 34 is uncoupled from the rear rotor 20, allowing the key rotor 13 to be freely rotatable.

Therefore, if the key rotor 13 is continuously rotated, the lower piece 36 of the coupling member 34 is inserted into the release portion 22, allowing the key rotor 13 to rotate. However, the rear rotor 20 and hence the lock lever 24 do not rotate, which does not allow the cylinder lock to be unlocked. That is, even if the key rotor 13 is rotated by a wrong key or the like, the key rotor 13, the sleeve 8, and the coupling member 34 only rotate idly, thereby not allowing the cylinder lock to be unlocked nor giving any damaging force to the respective components thereof. As a result, not only the possibility of the components being broken is excluded, but also the cylinder lock can be used again.

It should be noted that if the lock lever 24 is rotated wrongfully, the rear rotor 20 and the key rotor 13 rotate slightly, and the sleeve 8 also rotates slightly, thereby causing the moving element 27 to move in the direction of the arrow A2. As a result, the intermediate block 30 moves, which in turn causes a part 30*a* (see FIG. 6) of the intermediate block 30 to be abutted against either one of the retaining portions 6, 6 (see also FIG. 6) of the case main body 3. Hence, the rotation of the lock lever 24 is blocked, thereby not allowing the cylinder lock to be unlocked.

According to the cylinder lock, which is the first embodiment, the key rotor 13, the sleeve 8, and the coupling member 34 only rotate idly although the key rotor is forcibly rotated by a key other than the regular key, a screwdriver, or the like. Therefore, not only the cylinder lock cannot be unlocked, but also no damaging force is applied to the components thereof such as the tumblers 16, the key rotor 13, and the sleeve 8, excluding the likelihood of these components being broken and thereby ensuring reuse of the cylinder lock.

Second Embodiment

A cylinder lock, which is asecond embodiment of the invention, will be described next with reference to FIGS. 11 to 27. FIGS. 11 to 16 show conditions with a key 41 being inserted; FIGS. 17 to 22 show the components; and FIGS. 23 to 27 show conditions with the key rotor being forcibly rotated by a wrong key or the like.

Referring first to FIGS. 11 to 18, a rotor case 42 is cylindrical, and a moving member setting groove 43 is formed in an upper portion of the rotor case 42. A spring hold plate 44 is attached to the upper portion of the moving member setting groove 43. Further, an arcuate groove 45 is formed in the rear of the rotor case 42 (on the right side as viewed in FIGS. 11 and 17) with retaining portions 45*a*, 45*a* formed on both sides of the groove 45. Still further, a sloped V-shaped original position engagement recess 46 is formed in a position about 90° shifted in a circumferential direction with respect to the moving member setting groove 43.

Figure 20:
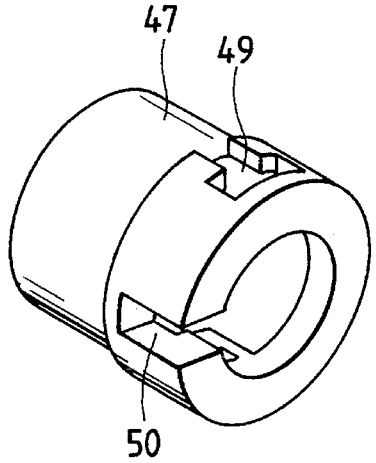
FIG. 20 is a perspective view of a sleeve.

A substantially cylindrical sleeve 47 is arranged in an intermediate portion inside the rotor case 42, the portion being intermediate as viewed in the axial direction. Tumbler engagement grooves 48, 48 are formed on the inner surface of the sleeve 47 so as to confront each other, and as shown in FIG. 20, not only a recessed cam portion 49 is formed on the outer surface thereof, but also a moving block setting hole 50 is formed in a position about 90° shifted in the circumferential direction with respect to the cam portion 49 so as to pass through in the radial direction.

A key rotor 51 is rotatably arranged inside the sleeve 47. The key rotor 51 is provided with a cover 52 so as not to be released frontward with respect to the rotor case 42. The key rotor 51 has an axially extending keyhole 53 and a plurality of radially extending tumbler setting grooves 54, 55. In this case, the front side portions of the tumbler setting grooves 54, 55 are different in shape from the rear side portions thereof. Two types of tumblers 56, 57 are set in these tumbler setting grooves 54, 55 so as to be movable in the radial directions. The respective tumblers 56, 57 are urged in a single direction by corresponding spring members 58.

The respective tumblers 56, 57 have ends thereof projected from the tumbler setting grooves 54, 55 and inserted into the tumbler engagement groove 48 of the sleeve 47 (see FIGS. 25 and 26), making the respective tumblers 56, 57 engageable with the sleeve 47 in the rotational direction. As the regular key 41 is inserted into the keyhole 53, the respective tumblers 56, 57 are moved in such a direction as to be set in the tumbler setting grooves 54, 55, thereby being released from the tumbler engagement groove 48 (see FIGS. 13 and 14).

Further, a shaft portion 59 is projected from the rear of the key rotor 51. A lock lever engagement recess 60 is formed on top of the root of the shaft portion 59 as shown also in FIG. 19. Still further, an engagement recess 61 is formed on the outer surface on the rear side of the key rotor 51 so as to confront the original position engagement recess 46.

Figure 11:
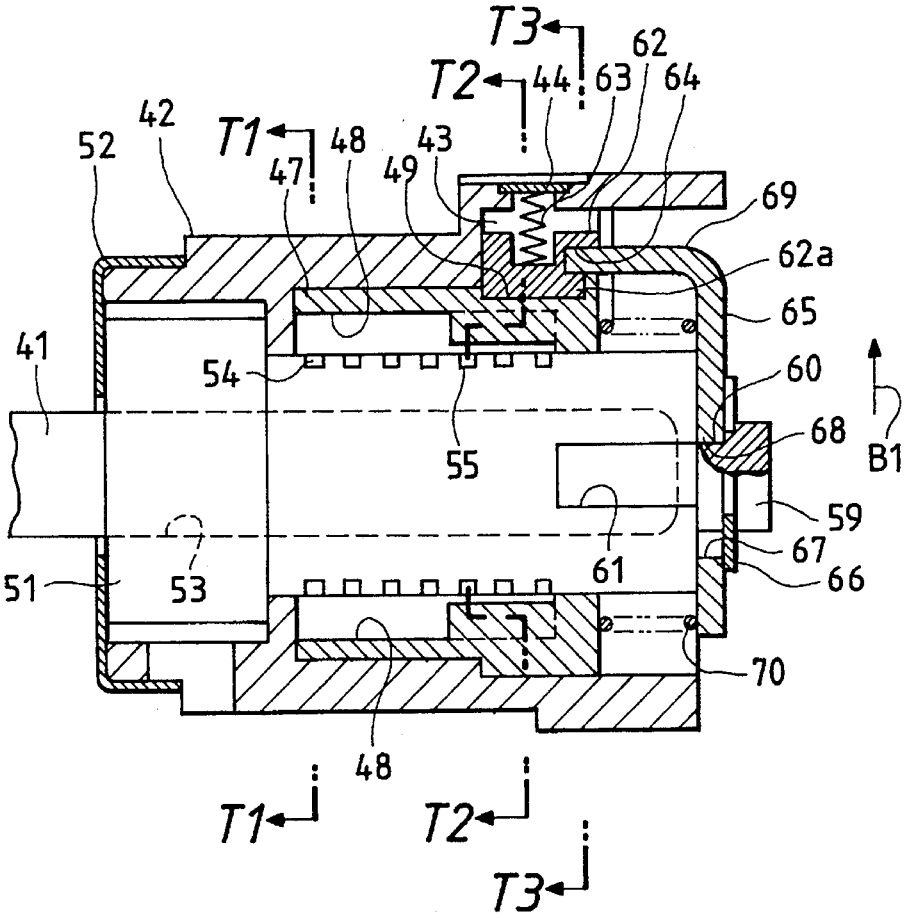
FIG. 11 is a longitudinal sectional side view of a second embodiment of the invention with a regular key inserted.
Figure 21:
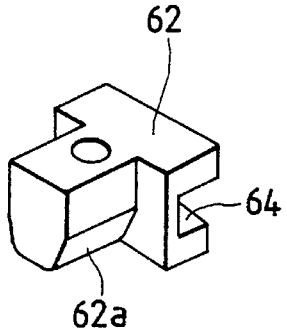
FIG. 21 is a perspective view of a moving member.

A moving member 62 shown in FIG. 21 is arranged in the moving member setting groove 43 of the rotor case 42 so as to be movable in a circumferential direction (up and down as viewed in FIG. 11). The moving member 62 is urged toward the sleeve 47 by a spring member 63 that-is interposed between the moving member 62 and the spring hold plate 44 with a fitting portion 62*a* thereof fitted into the cam portion 49 on the sleeve side 47, and is arranged so as to bridge between the rotor case 42 and the sleeve 47. On the rear side of the moving member 62 is a retaining groove 64 that has openings on the rear as well as on both left and right sides (see FIG. 15).

Figure 23:
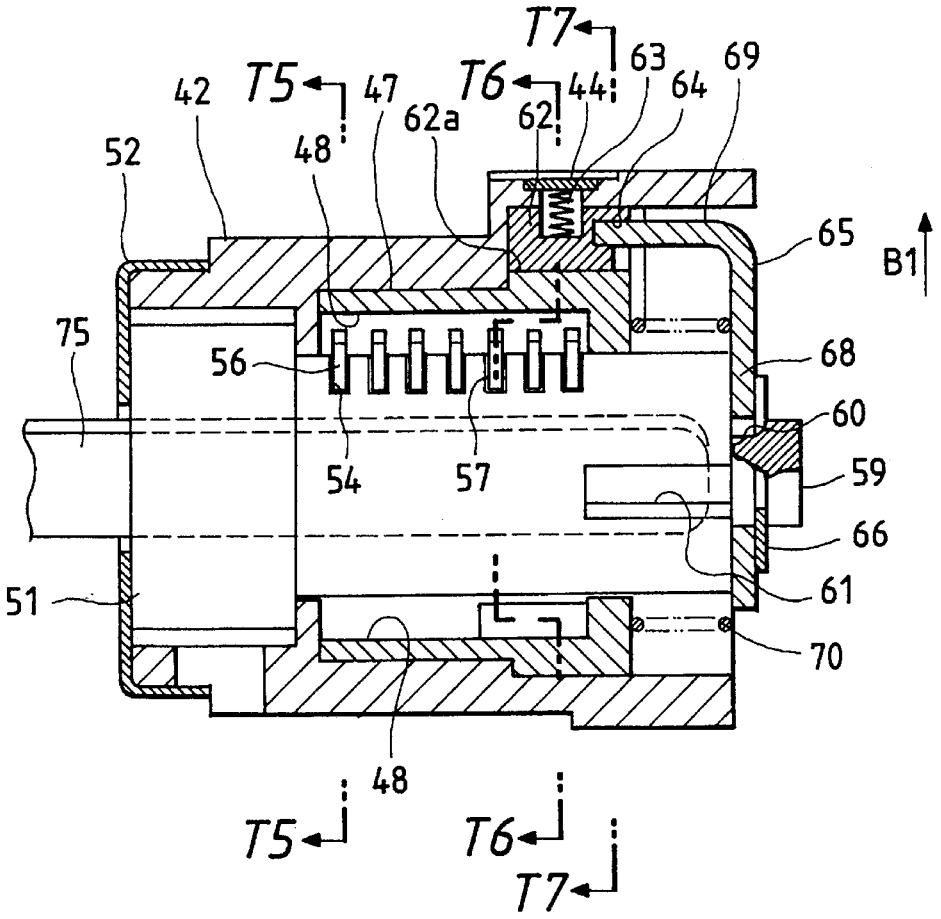
Figure 26:
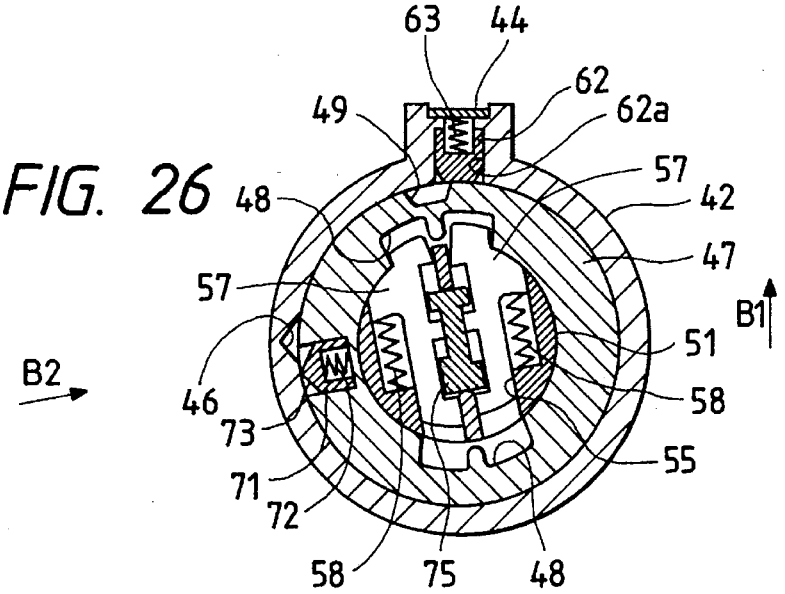
FIG. 26 is a sectional view taken along a line T6—T6 in FIG. 23.
Figure 27:
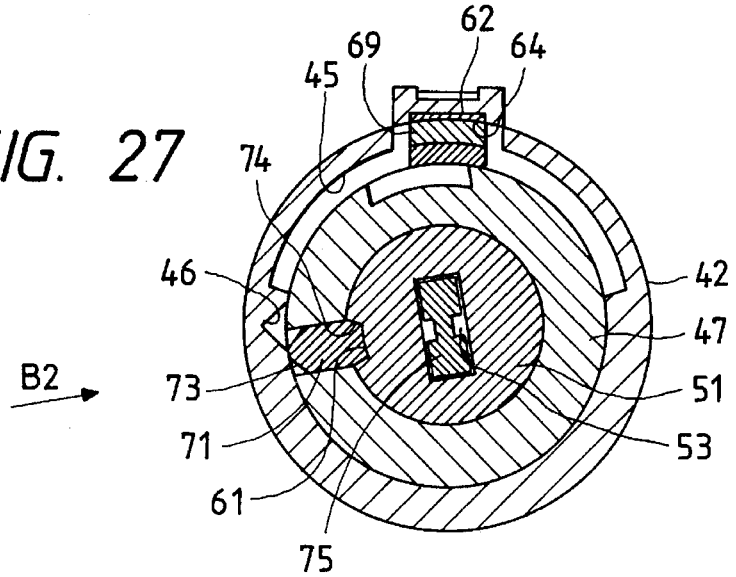
FIG. 27 is a sectional view taken along a line T7—T7 in FIG. 23.
Figure 28:
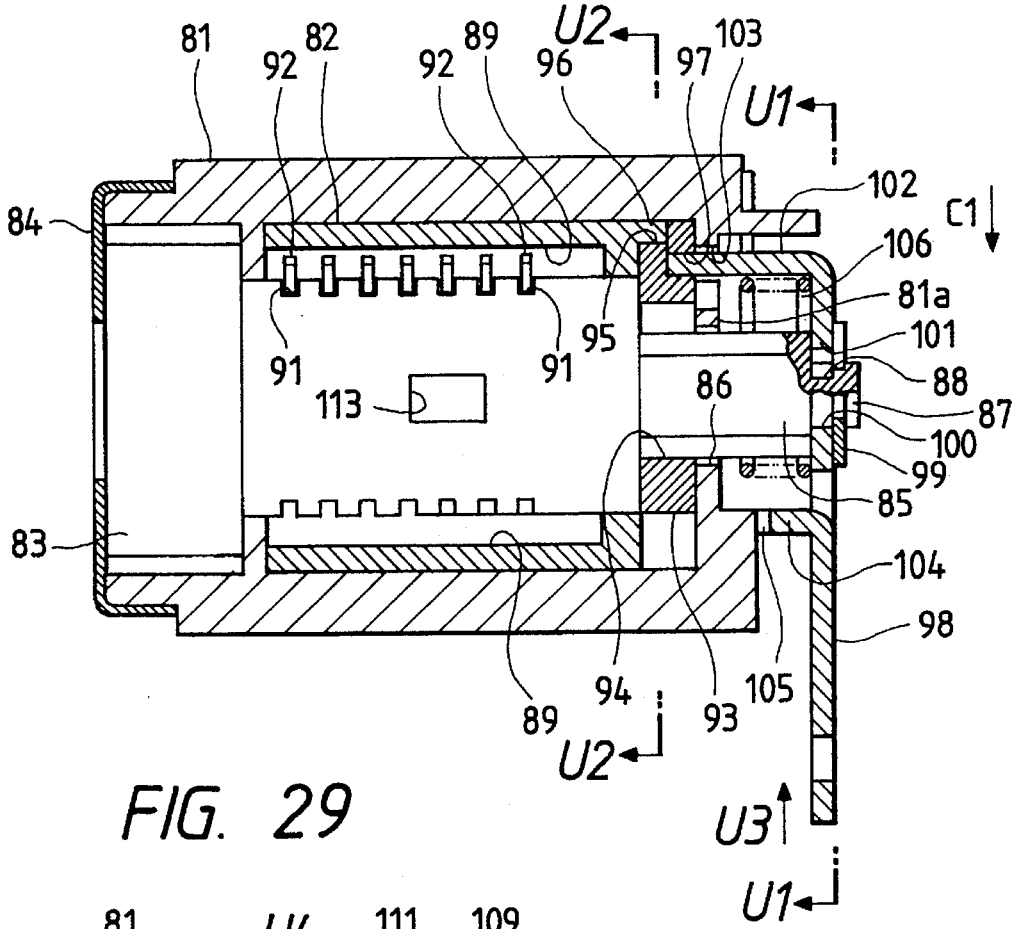
FIG. 28 is a longitudinal sectional side view of a third embodiment of the invention before a key is inserted.

The moving member 62 is movable in the radial directions between a coupling position at which the fitting portion 62*a* is fitted into the cam portion 49 (see FIGS. 11, 14, and 15) and an uncoupling position at which the fitting portion 62*a* comes out of the cam portion 49 as a result of the rotation of the sleeve 47 (see FIGS. 23, 26, and 27).

A lock lever 65 is attached to the shaft portion 59 of the key rotor 51 so as to be unreleasable by an E ring 66. In the lock lever 65 a fitting hole 67 into which the shaft portion 59 is fitted is elongated in a single radial direction, and a projection 68 engageable with the lock lever engagement recess 60 on the shaft portion 59 side is formed on a part of the fitting hole 67. Further, a retaining projection 69 that is retained in the retaining groove 64 of the moving member 62 is arranged integrally with the lock lever 65.

Figure 12:
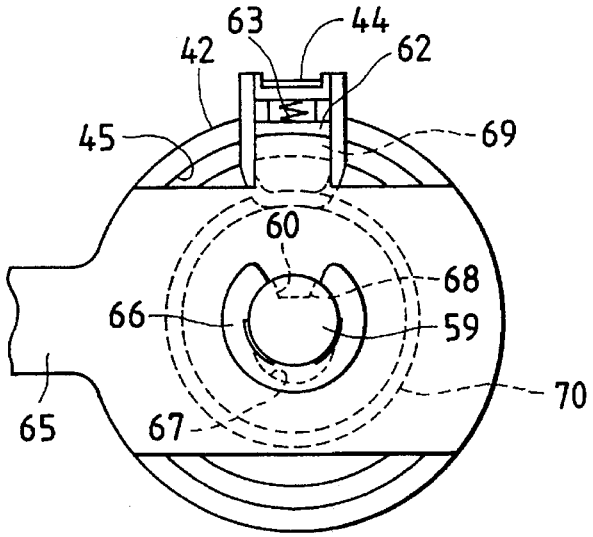
FIG. 12 is a rear view of the second embodiment of the present invention.
Figure 24:
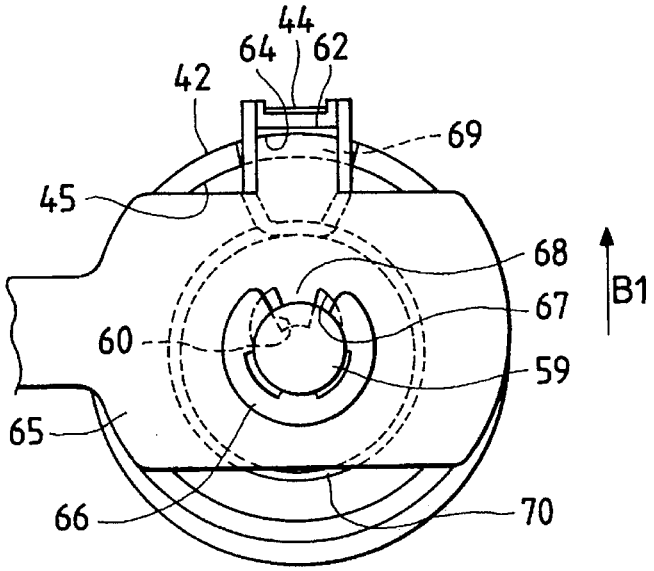
FIG. 24 is a rear view.
Figure 25:
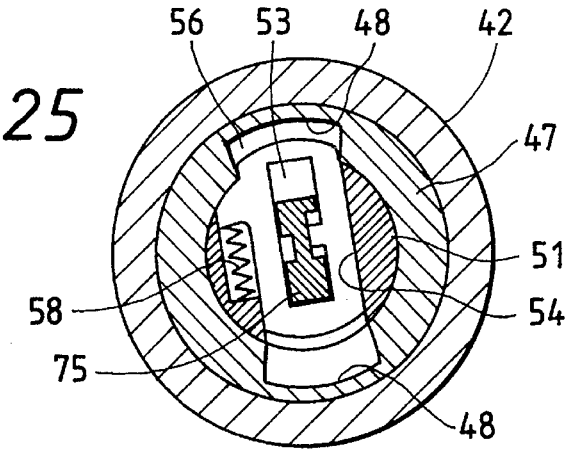
FIG. 25 is a sectional view taken along a line T5—T5 in FIG. 23.

The lock lever 65 is movable in the radial directions between an engagement position at which the projection 68 is engaged with the lock lever engagement recess 60 as shown in FIGS. 11 and 12 and a disengagement position at which the projection 68 is disengaged from the lock lever engagement recess 60 as shown in FIGS. 23 and 24. The lock lever 65 is rotatable integrally with the key rotor 51 with the projection 68 engaged with the lock lever engagement recess 60.

A return spring 70, which is a torsion spring, is provided in an outer circumferential portion in the rear of the key rotor 51. This return spring 70 gives a force for urging the lock lever 65 and the key rotor 51 to an original position when the lock lever 65 and the key rotor 51 are rotated from the original position.

Figure 22:
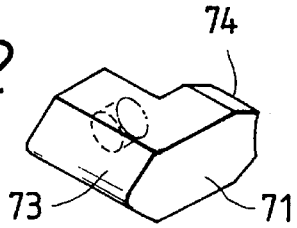
FIG. 22 is a perspective view of a moving block.

A moving block 71 shown in FIG. 22 is movably arranged in the moving block setting hole 50 of the sleeve 47. This moving block 71 is urged toward the rotor case 42 by a spring member 72, and holds the sleeve 47 in the original position with a first engagement portion 73 thereof engaged with the original position engagement recess 46 (see FIGS. 14 to 16). This moving block 71 has a second engagement portion 74 on the key rotor 51 side.

It should be noted that reference numeral 75 in FIGS. 23, 25 to 27 denotes a wrong key as a key other than the regular key.

A mode of operation of the aforementioned construction will be described next. In the condition before the key is inserted, the ends of the respective tumblers 56, 57 are inserted into the tumbler engagement grooves 48, 48 of the sleeve 47 by the spring members 58. That is, the respective tumblers 56, 57 are readily engageable with the sleeve 47 in the rotational direction (see FIGS. 25 and 26). Therefore, under this condition, the key rotor 51 and the sleeve 47 are rotatable integrally with each other. In addition, not only the moving member 62 is set to the coupling position, but also the lock lever 65 is set to the engagement position, so that the projection 68 of the lock lever 65 is engaged with the lock lever engagement recess 60 of the key rotor 51 (see FIGS. 11 and 12). Therefore, the key rotor 51 and the lock lever 65 are rotatable integrally with each other. At this instance, the engagement groove 64 of the moving member 62 is in communication with the groove 45 of the rotor case 42 (see FIG. 15).

In addition, the moving block 71 bridges between the sleeve 47 and the rotor case 42 while engaged with the original position engagement recess 46 of the rotor case 42. As a result of the engagement, the sleeve 47 is held in the original position.

Figure 13:
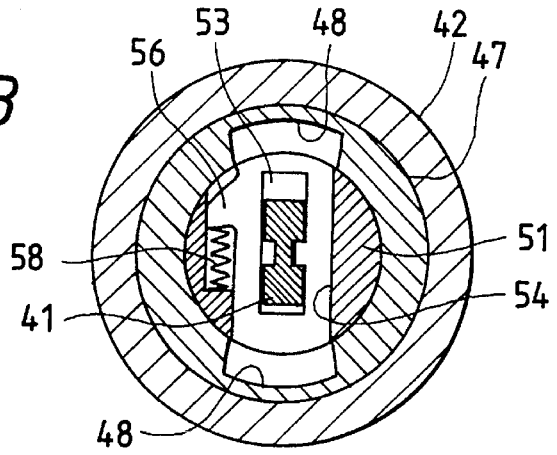
FIG. 13 is a sectional view taken along a line T1—T1 in FIG. 11.
Figure 14:
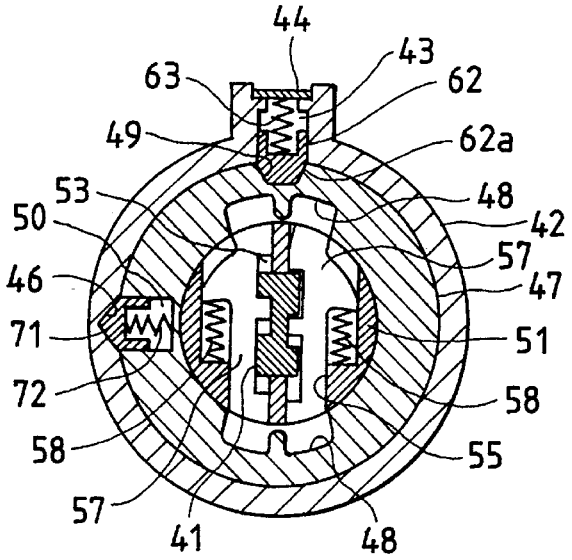
FIG. 14 is a sectional view taken along a line T2—T2 in FIG. 11.
Figure 15:
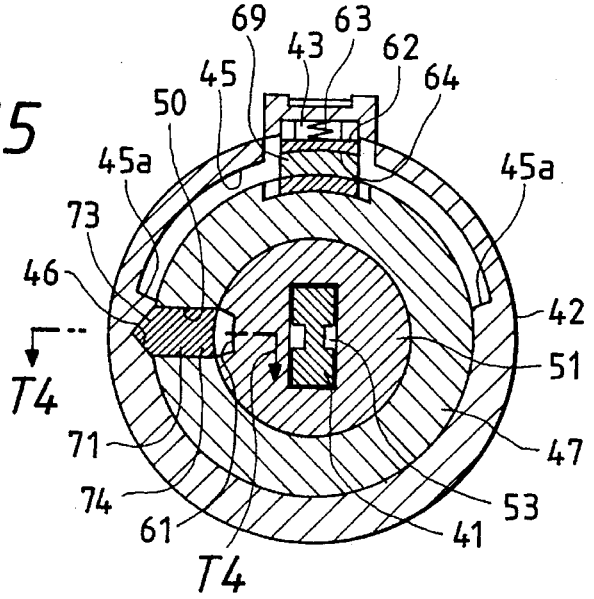
FIG. 15 is a sectional view taken along a line T3—T3 in FIG. 11.
Figure 16:
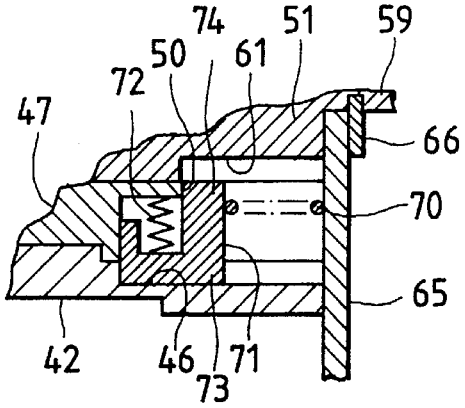
FIG. 16 is a sectional view taken along a line T4—T4 in FIG. 15.
Figure 17:
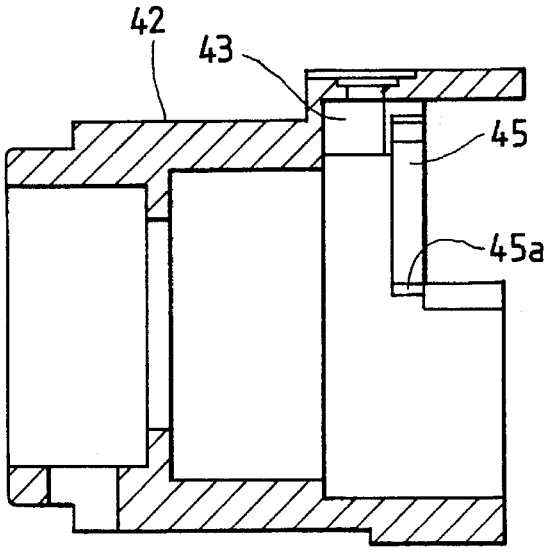
FIG. 17 is a longitudinal sectional side view of a rotor case.
Figure 18:
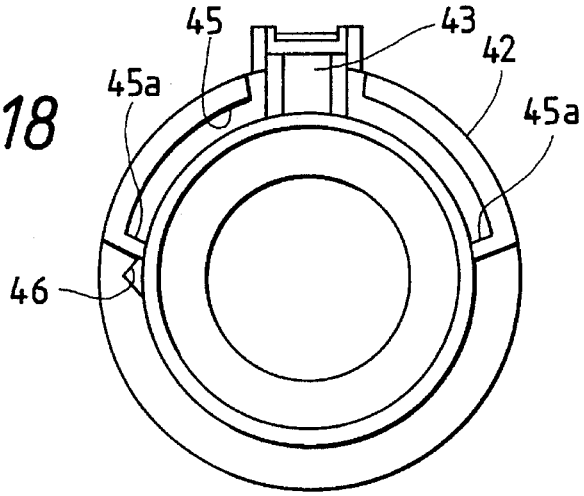
FIG. 18 is a rear view of the rotor case.
Figure 19:
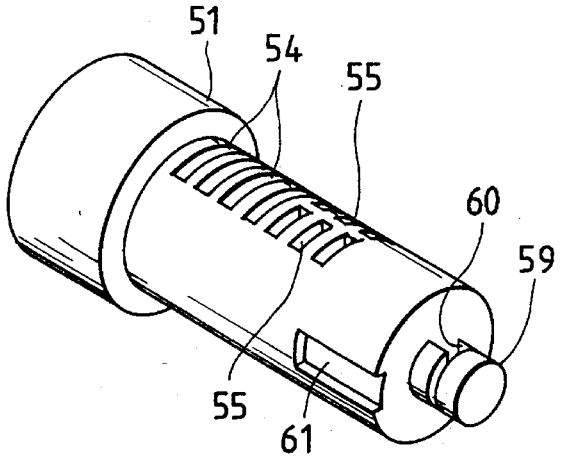
FIG. 19 is a perspective view of a key rotor.

When the regular key 41 is inserted into the keyhole 53 under this condition, the respective tumblers 56, 57 are released from the tumbler engagement grooves 48, 48 and set in the tumbler setting grooves 54, 55 (see FIGS. 13 and 14). As a result, the key rotor 51 is made freely rotatable with respect to the sleeve 47. Hence, as the inserted regular key 41 is rotated, the key rotor 51 is rotated with respect to the sleeve 47 and hence the rotor case 42, which in turn rotates the lock lever 65 that is engaged with the key rotor 51 integrally, thereby allowing the cylinder lock to be unlocked.

At this instance, the range of rotation of the key rotor 51 and the lock lever 65 is regulated by the retaining portions 45*a*, 45*a* of the rotor case 42. That is, the key rotor 51 and the lock lever 65 can rotate within the range of about 65° from the original position in both left and right directions. In addition, since the sleeve 47 does not rotate even if the key rotor 51 and the lock lever 65 are rotated within such range, the moving member 62 remains held in the coupling position.

Further, if a key other than the regular key, e.g., a wrong key 75, is inserted into the keyhole 53 to forcibly rotate the key rotor 51 under the aforementioned pre-insertion condition, at least some of the tumblers 56, 57 are engaged with the tumbler engagement groove 48. As a result, the key rotor 51 and the sleeve 47 are rotated integrally with each other (see FIGS. 25 to 27).

When the sleeve 47 is rotated, the moving member 62 is caused to move to the uncoupling position, which is up, by the slopes of the cam portion 49 arranged in the sleeve 47 (see an arrow B1 in FIGS. 23 and 26) and, in association therewith, the lock lever 65 is moved to the disengagement position, which is up (see the arrow B1 in FIG. 24), disengaging the projection 68 of the lock lever 65 from the lock lever engagement recess 60 of the key rotor 51. Further, when the sleeve 47 is rotated with respect to the rotor case 42, the moving block 71 is moved toward the key rotor 51 by the slopes of the original position engagement recess 46 (see an arrow B2 in FIGS. 26 and 27), which disengages the moving block 71 from the rotor case 42 and in turn engages the moving block 71 with the engagement recess 61 of the key rotor 51.

Therefore, in this case, the key rotor 51 and the sleeve 47 are rotated integrally with each other, but the lock lever 65 is not rotated. Thus, the cylinder lock is not unlocked. That is, even if the key rotor is forcibly rotated by the wrong key or the like, the key rotor 51 and the sleeve 47 only rotate idly, which neither unlocks the cylinder lock nor gives any damaging force to the components thereof, thereby excluding the possibility of the components being broken and allowing the cylinder lock to be used again.

By the way, when the wrong key 75 is released with the key rotor 51 and the sleeve 47 having been rotated to an arbitrary position from the original-position, the key rotor 51 and the sleeve 47 may, in some cases, be out of the original position.

In such a case, when the regular key 41 is inserted into the keyhole 53, the respective tumblers 56, 57 are moved to be set in the tumbler setting grooves 54, 55, so that the tumblers 56, 57 are disengaged from the sleeve 47. However, the moving block 71 is engaged so as to bridge between the sleeve 47 and the key rotor 51. Therefore, when the key rotor 51 is rotated by the regular key 41, the sleeve 47 is caused to rotate integrally with the key rotor 51. When the key rotor 51 and the sleeve 47 are rotated as far as to the original position, the first engagement portion 73 of the moving block 71 confronts the original position engagement recess 46 of the rotor case 42 and is thereby engaged therewith (see FIGS. 14 and 15). As a result, the key rotor 51 and the sleeve 47 come to be held in the original position.

In a manner similar to that of the first embodiment, the cylinder lock according to the second embodiment is provided as only rotating the key rotor 51 and the sleeve 47 idly and not rotating the lock lever 65 when the key rotor 51 is forcibly rotated by the insertion of the wrong key 75 or the like. Therefore, not only the cylinder lock is not unlocked, but also no damaging force is applied to the components thereof. As a result, there is no likelihood that the components will be broken, and the cylinder lock can therefore be used again.

The cylinder lock according to the second embodiment is further provided as holding the sleeve 47 in the original position by arranging the moving block 71 in the sleeve 47 and engaging the moving block 71 with the original position engagement recess 46 of the rotor case 42, as well as causing the moving block 71 to be engaged with the key rotor 51 to thereby rotate the sleeve 47 and the key rotor 51 integrally with each other if the sleeve 47 and the key rotor 51 are rotated by the wrong key 75. Therefore, the rotation of the sleeve 47 is prohibited at the time of legally unlocking and locking the cylinder lock. In addition, the original position of the sleeve 47 and the key rotor 51 can be identified.

Having no member that moves in the axial direction, the cylinder lock according to the second embodiment is further advantageous in preventing the cylinder lock from becoming large in the axial direction.

Third Embodiment

Figure 35:
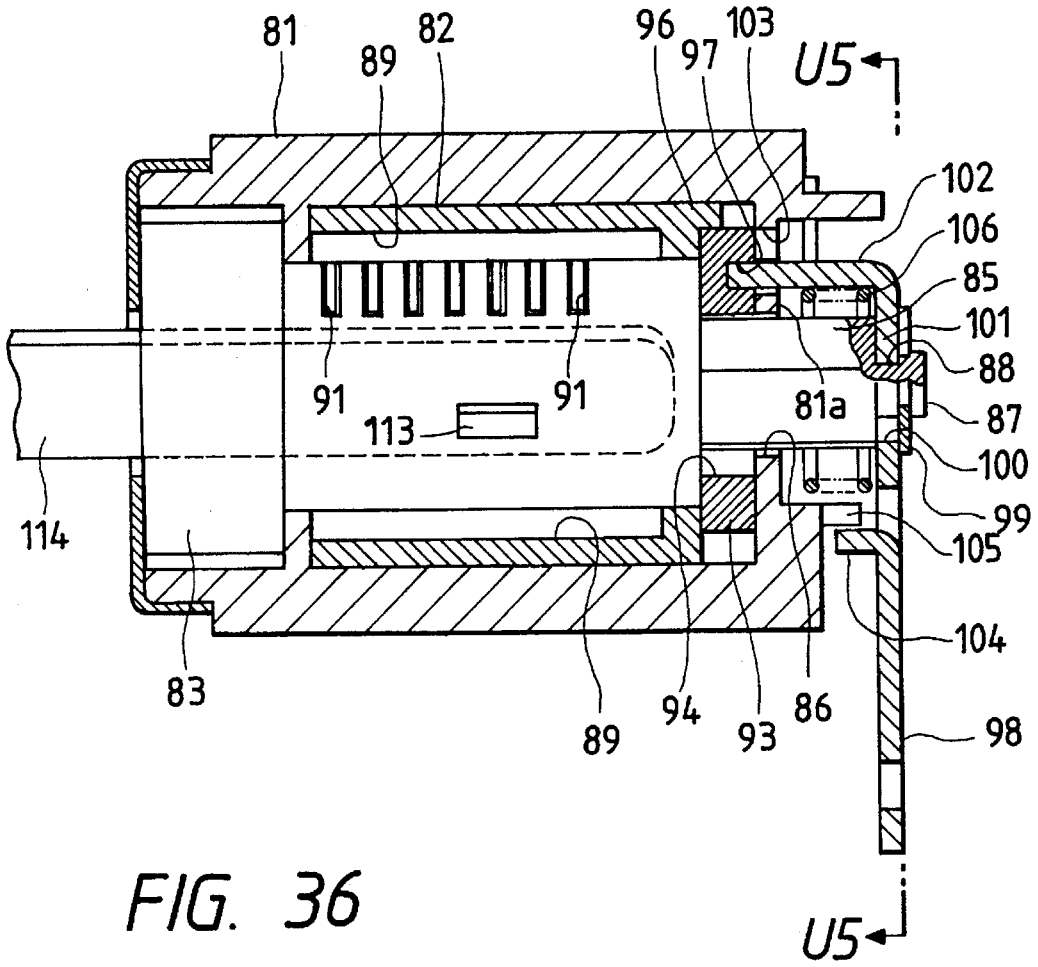
FIG. 35 is a view equivalent to FIG. 28 with the cylinder lock being opened by inserting a regular key.
Figure 36:
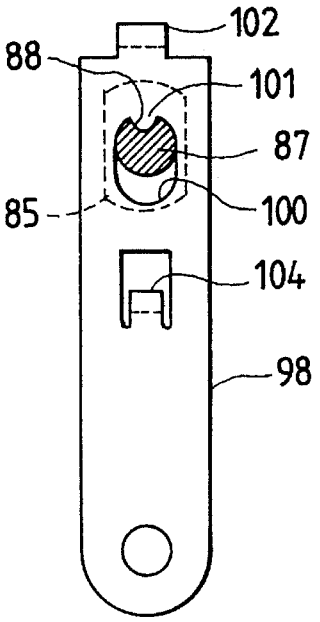
FIG. 36 is a sectional view taken along a line U5—U5 in FIG. 35.
Figure 37:
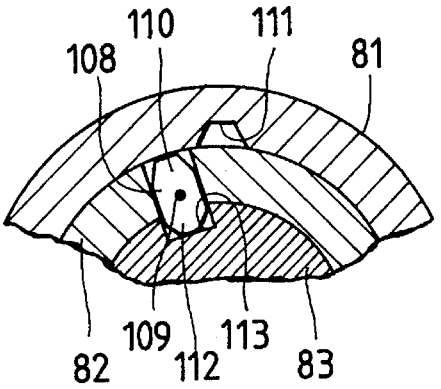
FIG. 37 is a view equivalent to FIG. 34 with the moving block engaged with the sleeve and the key rotor.

A cylinder lock, which is a third embodiment of the invention, will be described next with reference to FIGS. 28 to 37. FIGS. 28 to 34 show conditions before a key is inserted as well as components; FIGS. 35 and 36 show conditions with a regular key inserted; and FIG. 37 shows a condition when the key rotor is forcibly rotated by a wrong key or the like.

Referring, first, to FIGS. 28 to 34, a cylindrical sleeve 82 is rotatably arranged inside a cylindrical rotor case 81. A key rotor 83 is rotatably arranged inside the sleeve 82. The key rotor 83 is provided with a cover 84 so as not to be released frontward. A shaft portion 85 in the rear (on the right portion as viewed in FIG. 28) of the key rotor 83 is projected rearward from a shaft insertion hole 86. The shaft portion 85 is substantially oval in section (see FIG. 31), and has a projection 87 at the rear end thereof. A lock lever engagement recess 88 (see FIG. 30) is formed on the projection 87.

Tumbler engagement grooves 89, 89 are formed on the inner surface of the sleeve 82 so as to confront each other. Not only a keyhole (not shown) is formed in the key rotor 83 in the axial direction, but also a plurality of radially extending tumbler setting grooves 91 are formed. The respective tumbler setting grooves 91 have tumblers 92 movably set therein, and the respective tumblers 92 are urged so as to move in a single direction by not shown corresponding springs.

A rear rotor 93 is fitted with the shaft portion 85 of the key rotor 83 while positioned inside the rotor case 81. A fitting hole 94 of the rear rotor 93 that is fitted with the shaft portion 85 is elongated in the radial direction (see FIGS. 31 and 32), so that the rear rotor 93 rotates integrally with the key rotor 83 and is movable in the radial direction with respect to the key rotor 83.

A recess 95 is formed on an upper portion of the rear rotor 93. A cam portion 96 arranged at the rear end portion of the sleeve 82 is fitted into this recess 95. Further, on the rear side of the rear rotor 93 is an arcuate retaining groove 97 (see FIG. 32).

A lock lever 98 is engaged with the projection 87 of the key rotor 83 so as to be unreleasable by an E ring 99. A fitting hole 100 of the lock lever 98 that is fitted with the projection 87 is elongated in the radial direction (see FIG. 30). On an upper portion of the fitting hole 100 is a projection 101 engageable with the lock lever engagement recess 88. The projection 101 is formed so as to face downward. On an upper portion of the lock lever 98 is a retaining projection 102 that faces frontward. The front end of the retaining projection 102 is movably inserted into the retaining groove 97 of the rear rotor 93 so as to pass through a hole 103 formed in a rear wall 81*a* of the rotor case 81.

Further, in the lock lever 98 a retaining piece 104 is formed below the fitting hole 100 by cutting a piece and raising the cut piece frontward. This retaining piece 104 is inserted between stopper projections 105, 105 arranged on the rear wall 81*a* of the rotor case 81 (see FIG. 33).

A return spring 106, which is a torsion spring, is arranged around the shaft portion 85 of the key rotor 83. This return spring 106 imparts a force for urging the key rotor 83 and the lock lever 98 to an original position when the key rotor 83 and the lock lever 98 are rotated from the original position. Further, the lock lever 98 is urged upward as viewed in FIG. 28 by this return spring 106.

In this case, under the pre-insertion condition, the lock lever 98 is set to a disengagement position, which is up, and the rear rotor 93 engaged with the lock lever 98 is set to an uncoupling position, which is up. Under such condition, the projection 101 of the lock lever 98 is disengaged from the lock lever engagement recess 88 of the key rotor 83 (see FIG. 30).

Figure 29:
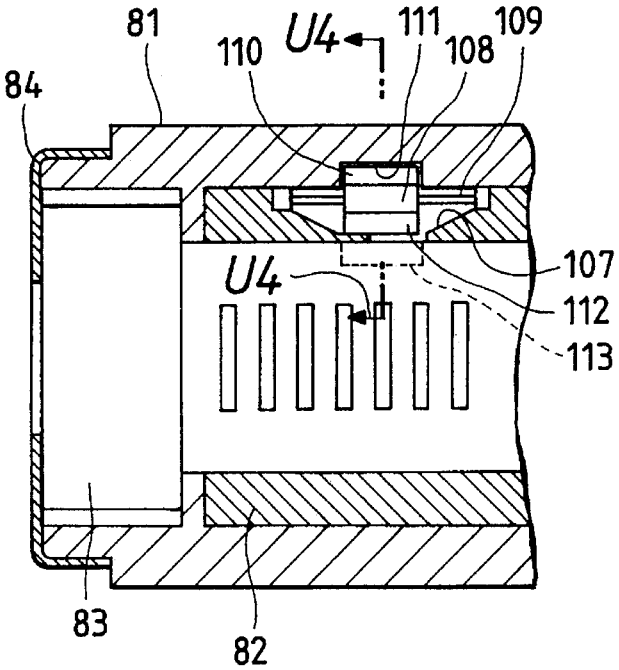
FIG. 29 is a longitudinal sectional side view of a portion different from that shown in FIG. 28.
Figure 30:
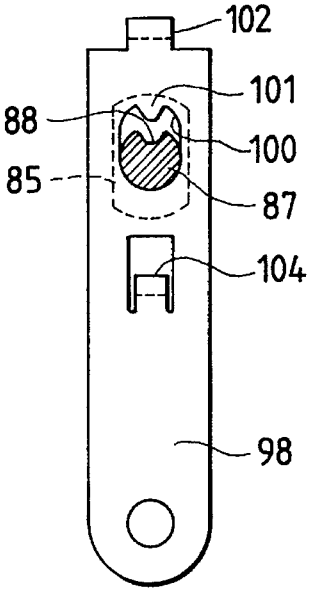
FIG. 30 is a sectional view taken along a line U1—U1 in FIG. 28.
Figure 31:
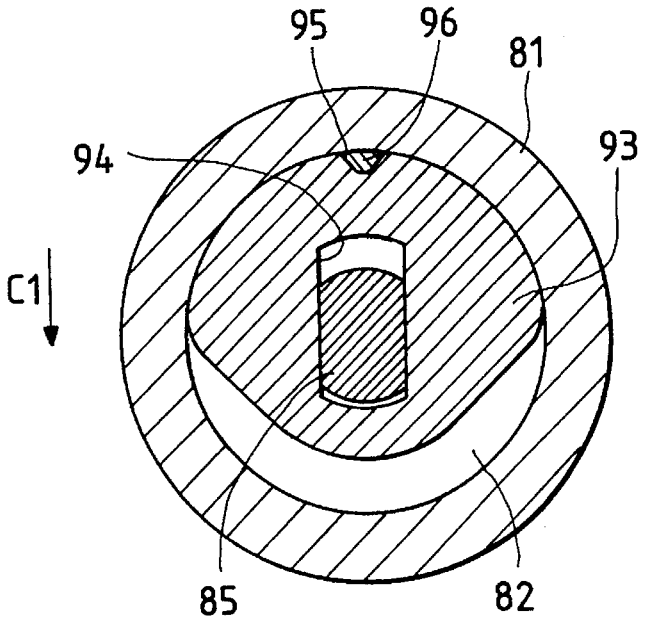
FIG. 31 is a sectional view taken along a line U2—U2 in FIG. 28.
Figure 33:
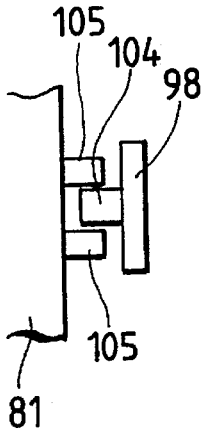
FIG. 33 is a partial bottom view as viewed from a direction indicated by an arrow U3 shown in FIG. 28.
Figure 32:
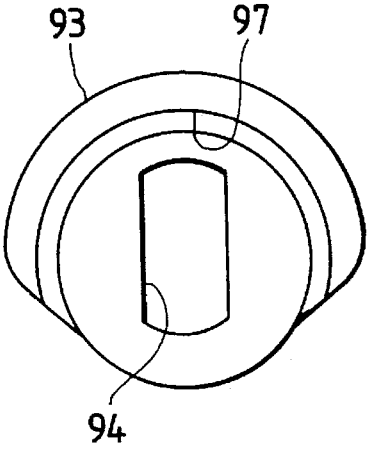
FIG. 32 is a rear view of the rear rotor.
Figure 34:
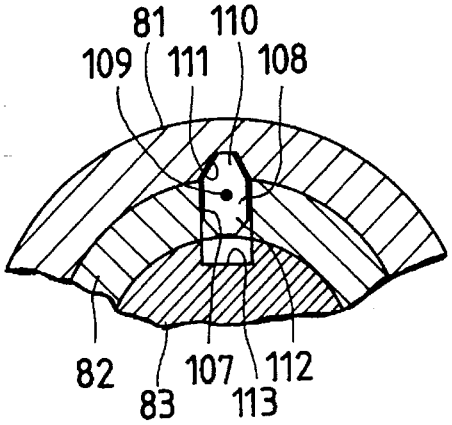
FIG. 34 is a sectional view taken along a line U4—U4 in FIG. 29.

In FIGS. 29 and 34 a moving block setting hole 107 is formed in the sleeve 82, and a moving block 108 is set in the moving block setting hole 107 so as to be movable in the radial directions. This moving block 108 is urged toward the rotor case 81 by a pin-like spring member 109 that is arranged so as to pass through the moving block 108.

On the rotor case 81 side is an original position engagement recess 111 engageable with a first engagement portion 110 on one side of the moving block 108. On the key rotor 83 side is an engagement recess 113 engageable with a second engagement portion 112 on the other end of the moving block 108. It should be noted that reference numeral 114 in FIG. 35 denotes a regular key.

A mode of operation of the aforementioned construction will be described next. Under the condition before the key is inserted, the respective tumblers 92 have the ends thereof inserted into the tumbler engagement groove 89 of the sleeve 82, and therefore are readily engageable with the sleeve 82 in the rotational direction. Therefore, the key rotor 83 and the sleeve 82 are rotatable integrally with each other under this condition. Further, the rear rotor 93 is set to the uncoupling position, and the lock lever 98 is set to the disengagement position, so that the lock lever 98 and the key rotor 93 are readily disengageable from each other.

Further, by the moving block 108 being brought into engagement with the original position engagement recess 111 of the rotor case 81, the moving block 108 bridge between the sleeve 82 and the rotor case 81, so that the sleeve 82 is held in the original position by the engagement.

When the regular key 114 is inserted into the keyhole of the key rotor 83 under this condition, the respective tumblers 92 are released from the tumbler engagement groove 89 and thereby set in the tumbler setting groove 91. As a result, the key rotor 83 is made freely rotatable with respect to the sleeve 82. As the inserted regular key 114 is rotated, the key rotor 83 is rotated with respect to the sleeve 82, which in turn rotates the rear rotor 93 integrally with the key rotor 83.

Then, while being rotated, the rear rotor 93 is caused to move to the coupling position (see FIG. 35), which is down, by the cam portion 96 arranged in the sleeve 82 and, in association therewith, the lock lever 98 is moved to the engagement position (see FIGS. 35 and 36), thereby engaging the projection 101 of the lock lever 98 with the lock lever engagement recess 88 of the key rotor 83. Further, in association with the movement of the lock lever 98 to the engagement position, the retaining piece 104 is displaced downward from the stopper projections 105, 105, which in turn allows the lock lever 98 to rotate. At a result, the key rotor 83 and the lock lever 98 are rotated integrally with each other, thus allowing the cylinder lock to be unlocked.

At this instance, the range of rotation of the lock lever 98 is regulated by the hole 103 Df the rotor case 81. In addition, since the sleeve 82 is held in the original position by the moving block 108 in this case, the sleeve 82 does not rotate although the key rotor 83, the rear rotor 93, and the lock lever 98 are rotated integrally with one another.

Further, under the aforementioned pre-insertion condition, a key other than the regular key, e.g., a wrong key (not shown) is inserted into the keyhole to forcibly rotate the key rotor. In this case, at least some of the tumblers 92 are brought into engagement with the tumbler engagement groove 89, so that the key rotor 83, the sleeve 82, and the rear rotor 93 rotate integrally with one another. When the sleeve 82 and the rear rotor 93 rotate integrally, the relative positions of the sleeve 82 and the rear rotor 93 remain unchanged. As a result, the rear rotor 93 remains in the disengagement position, and the lock lever 98 remains in the disengagement position as well.

When the sleeve 82 is rotated with respect to the rotor case 81, the moving block 108 is moved toward the key rotor 83 by the slopes of the original position engagement recess 111, which in turn disengages the moving block 108 from the rotor case 81 and engages the moving block 108 with the engagement recess 113 of the key rotor 83 (see FIG. 37).

Since the key rotor 83, the sleeve 82, and the rear rotor 93 rotate integrally with one another, but the lock lever 98 does not rotate in this case, thereby not allowing the cylinder lock to be unlocked. That is, even if the key rotor is forcibly rotated by a wrong key or the like, the key rotor 83, the sleeve 82, and the rear rotor 93 only rotate idly, thereby neither allowing the cylinder lock to be unlocked, nor allowing a damaging force to be applied to the components thereof. Hence, the possibility of the components being broken is excluded, and the cylinder lock can therefore be used again.

By the way, when the wrong key is released with the key rotor 83, the sleeve 82, and the rear rotor 93 having been rotated to an arbitrary position from the original position, the key rotor 83, the sleeve 82, and the rear rotor 93 may, in some cases, be out of the original position also in the third embodiment.

In such a case, when the regular key 114 is inserted into the keyhole, the respective tumblers 92 are moved so as to be set in the tumbler setting groove 91, so that the tumblers 92 are disengaged from the sleeve 82. However, the moving block 108 is engaged so as to bridge between the sleeve 82 and the key rotor 83. Therefore, when the key rotor 83 is rotated by the regular key 114, the sleeve 82 is rotated integrally with the key rotor 83. When the key rotor 83 and the sleeve 82 are rotated as far as to the original position, the first engagement portion 110 of the moving block 108 confronts the original position engagement recess 111 of the rotor case 81 and thereby is engaged therewith (see FIG. 34). As a result, the key rotor 83 and the sleeve 82 come to be held in the original position.

In a manner similar to those of the first and second embodiments, the cylinder lock according to the third embodiment is provided as only rotating the key rotor 83, the sleeve 82, and the rear rotor 93 idly and not rotating the lock lever 98 when the key rotor 83 is forcibly rotated by the insertion of a wrong key or the like. Therefore, not only the cylinder lock is not unlocked, but also no damaging force is applied to the components thereof. As a result, there is no likelihood that the components will be broken, and the cylinder lock can therefore be used again.

Further, in a manner similar to that of the second embodiment, the cylinder lock according to the third embodiment is also provided as holding the sleeve 82 in the original position by arranging the moving block 108 in the sleeve 82 and engaging the moving block 108 with the original position engagement recess 111 of the rotor case 81, as well as causing the moving block 108 to be engaged with the key rotor 83 to thereby rotate the sleeve 82 and the key rotor 83 integrally with each other if the sleeve 82 and the key rotor 83 are rotated by a wrong key or the like. Therefore, the rotation of the sleeve 82 is prohibited at the time of legally unlocking and locking the cylinder lock. In addition, the original position of the sleeve 82 and the key rotor 83 can be identified.

Having no member that moves in the axial direction, the cylinder lock according to the third embodiment is further advantageous in preventing the cylinder lock from becoming large in the axial direction.

Still further, since the retaining piece 104 of the lock lever 98 is interposed between the stopper projections 105, 105 under the pre-insertion condition, the lock lever 98 cannot be rotated even if one tries to rotate the lock lever 98 directly from outside with the cylinder lock locked.

Fourth Embodiment

Figure 42:
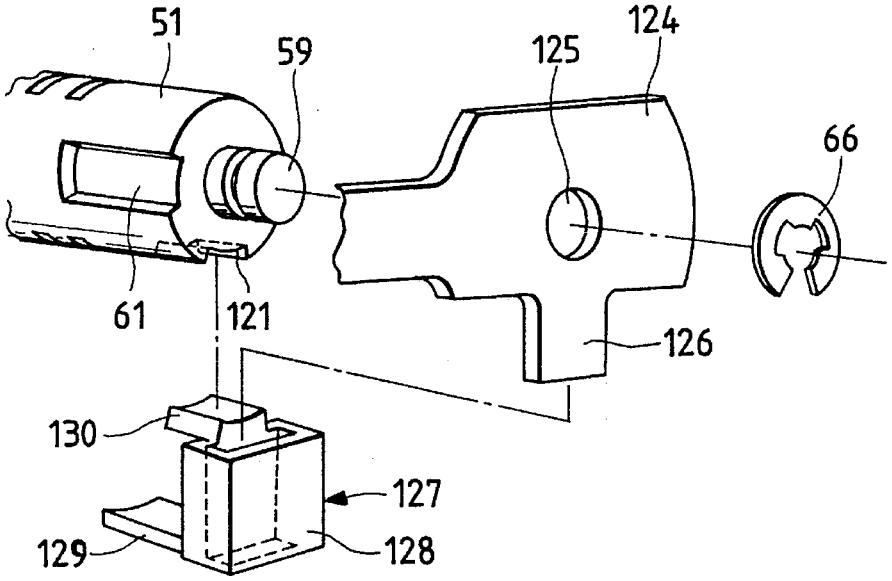
FIG. 42 is an exploded perspective view of a main portion.

A cylinder lock, which is a fourth embodiment of the invention, will be described next with reference to FIGS. 38 to 46. Since the basic construction of the fourth embodiment is the same as that of the second embodiment, the same components are designated by the same reference characters, and the descriptions thereof will be omitted. Only the different components will be described. FIGS. 38 to 41 show conditions before the regular key 41 is inserted; FIG. 42 shows a main portion of major components in exploded perspective form; and FIGS. 43 to 46 show conditions in which the key rotor is forcibly rotated by a wrong key or the like.

First, in the rotor case 42, the moving member setting groove 43 and the arcuate groove 45 having the retaining portions **45*a* are formed on a lower portion in the drawings. The recessed original position engagement recess 46 having slopes is formed in a position about 90° shifted in the circumferential direction with respect to the moving member setting groove 43. On the outer surface on the rear side of the key rotor 51 arranged inside the sleeve 47 is the engagement recess 61 as shown in FIG. 42. A coupling member engagement recess 121 is also formed in a position about 90° shifted in the circumferential direction with respect to the engagement recess 61**.

Figure 38:
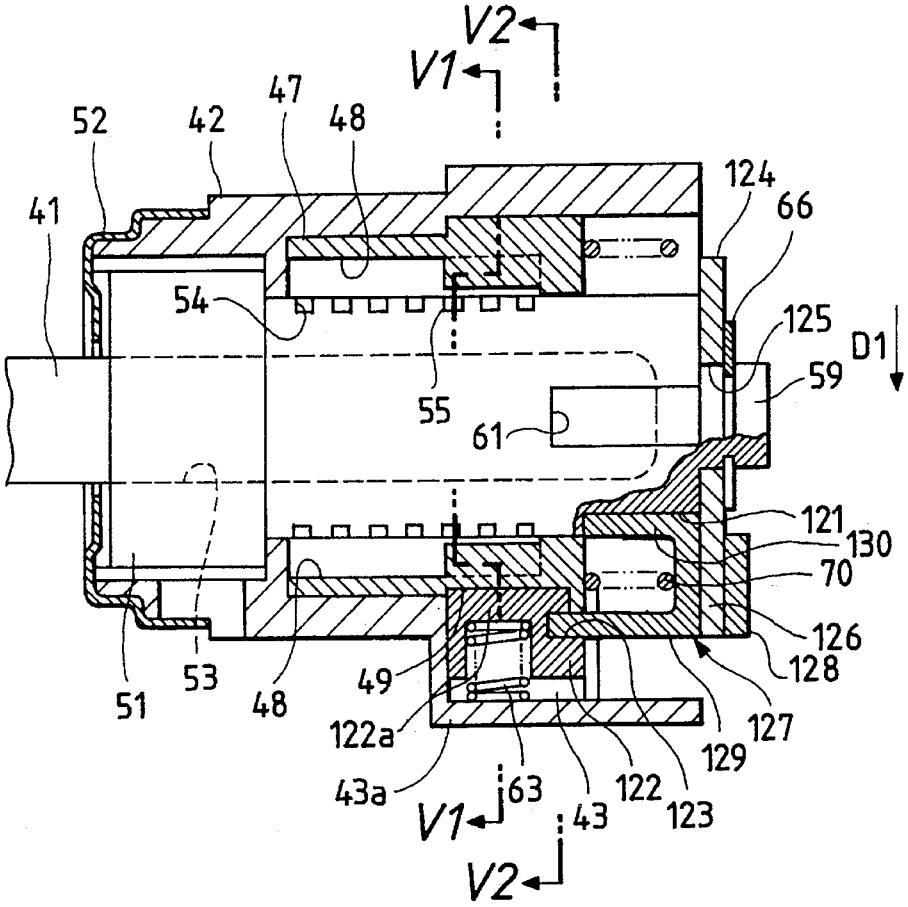
FIG. 38 is a longitudinal sectional side view of a fourth embodiment of the invention with a regular key inserted.

The moving member setting groove 43 has a moving member 122 arranged so as to be movable in the circumferential direction (up and down as viewed in FIG. 38). The moving member 122 is urged toward the sleeve 47 by the spring member 63 interposed between the moving member 122 and a spring receiving portion **43*a*. A fitting portion 122*a* is fitted with the cam portion 49 on the sleeve 47 side. That is, the moving member 122 is arranged so as to bridge between the rotor case 42 and the sleeve 47. On the rear side of the moving member 122 is a retaining groove 123 that is opened on the rear as well as both left and right sides (see FIG. 41**).

Figure 43:
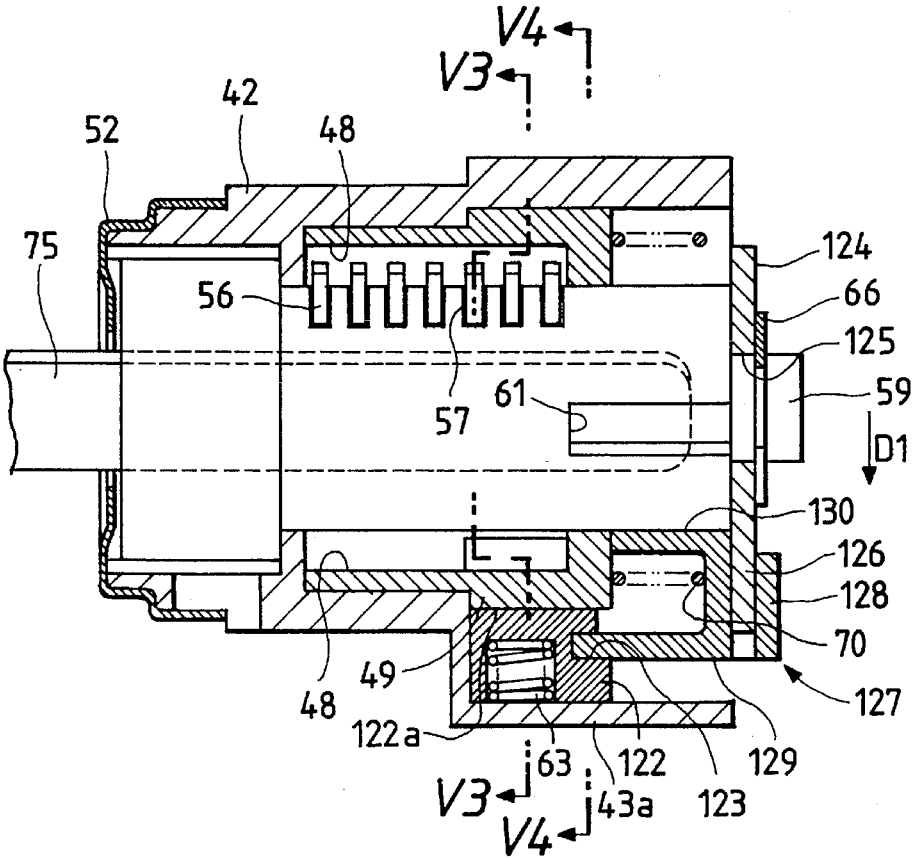
Figure 45:
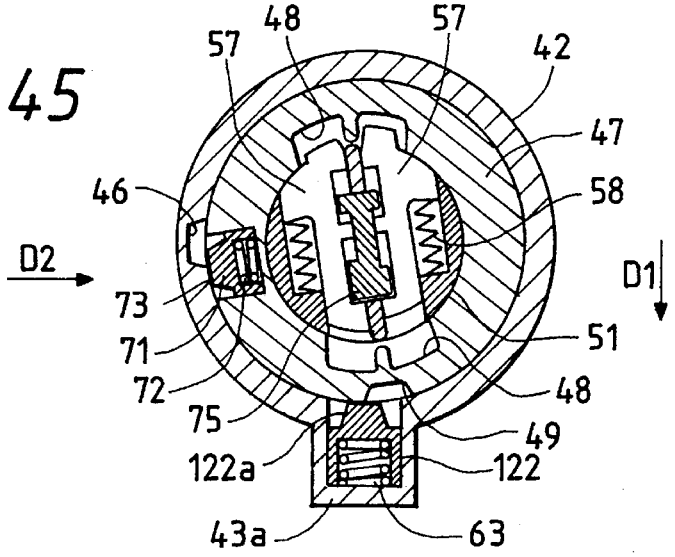
FIG. 45 is a sectional view taken along a line V3—V3 in FIG. 43.
Figure 46:
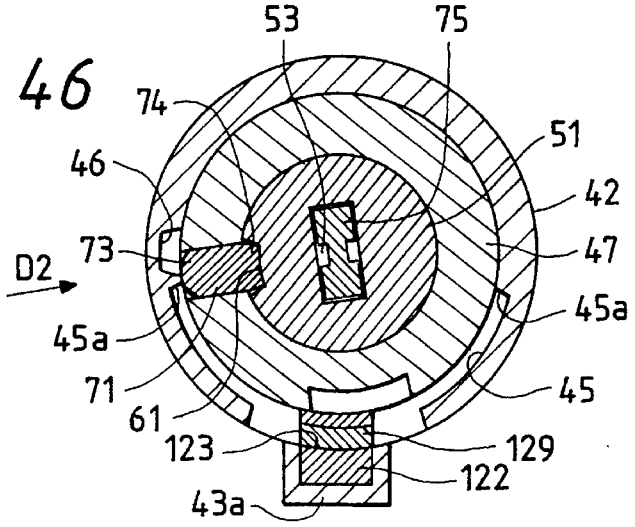
FIG. 46 is a sectional view taken along a line V4—V4 in FIG. 43.

This moving member 122 is designed to be movable in the radial directions between the coupling position at which the fitting portion **122*a* is fitted into the cam portion 49 (see FIGS. 38, 40, and 41) and the uncoupling position at which the fitting portion 122*a* is out of the cam portion 49 (see FIGS. 43, 45, and 46**).

A lock lever 124 is attached to the shaft portion 59 of the key rotor 51 so as to be unreleasable by the E ring 66. A fitting hole 125 of the lock lever 124 which is fitted with the shaft portion 59 is formed into a circular member so as to correspond to the shaft portion 59. In addition, a retaining piece 126 is formed on the lock lever 124 so as to face downward.

As shown in FIG. 42, a coupling member 127 includes a fitting rectangular cylinder portion 128 and axially extending retaining projection 129 and engagement projection 130 integrally. The fitting cylinder portion 128 is movably fitted with the retaining piece 126. The retaining projection 129 is inserted into the retaining groove 123 of the moving member 122. The engagement projection 130 is engaged with the coupling member engagement recess 121 of the key rotor 51.

Figure 39:
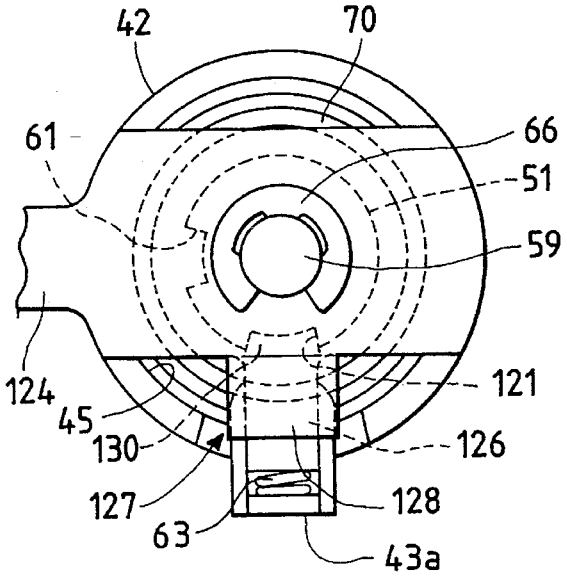
FIG. 39 is a rear view of the fourth embodiment of the present invention.
Figure 40:
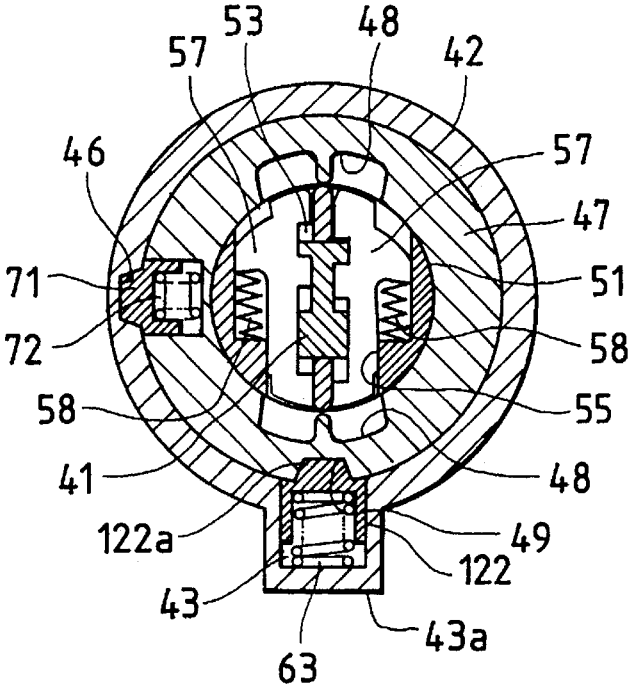
FIG. 40 is a sectional view taken along a line V1—V1 in FIG. 38.
Figure 41:
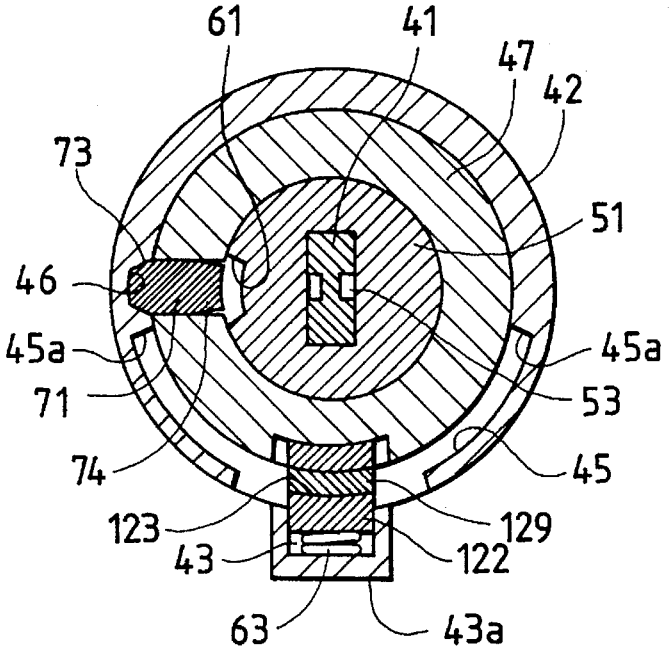
FIG. 41 is a sectional view taken along a line V2—V2 in FIG. 38.
Figure 44:
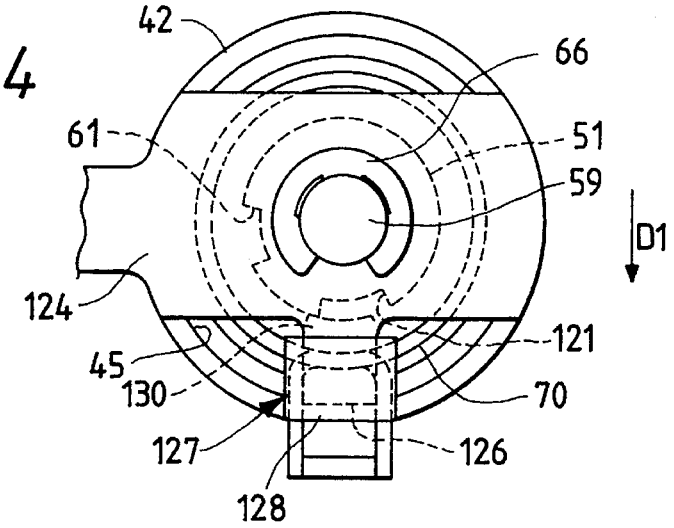
FIG. 44 is a rear view.

The coupling member 127 is movable in the radial directions between the engagement position at which the engagement projection 130 is engaged with the coupling member engagement recess 121 as shown in FIGS. 38 and 39 and the disengagement position at which the engagement projection 130 is disengaged from the coupling member engagement recess 121 as shown in FIGS. 43 and 44, so that the key rotor 51 and the lock lever 124 can be rotated integrally with each other with the engagement projection 130 engaged with the coupling member engagement recess 121.

A mode of operation of the aforementioned construction will be described next. In the condition before the key is inserted, the ends of the respective tumblers 56, 57 are inserted into the tumbler engagement grooves 48, 48 of the sleeve 47 by the spring members 58. That is, the respective tumblers 56, 57 are readily engageable with the sleeve 47 in the rotational direction (see FIG. 45). Under this condition, the key rotor 51 and the sleeve 47 are rotatable integrally with each other. In addition, not only the moving member 122 is set to the coupling position, but also the coupling member 127 is set to the engagement position, and the engagement projection portion 130 of the coupling member 127 is engaged with the coupling member engagement recess 121 of the key rotor 51 (see FIGS. 38 and 39), so that the key rotor 51 is readily engageable with the lock lever 124 through the coupling member 127. Therefore, the key rotor 51 and the lock lever 124 are rotatable integrally with each other. At this instance, the retaining groove 123 of the moving member 122 is in communication with the groove 45 of the rotor case 42 (see FIG. 41).

In addition, the moving block 71 bridges between the sleeve 47 and the rotor case 42 while engaged with the original position engagement recess 46 of the rotor case 42. As a result of the engagement, the sleeve 47 is held in the original position.

When the regular key 41 is inserted into the keyhole 53 under this condition, the respective tumblers 56, 57 are released from the tumbler engagement grooves 48, 48 and set in the tumbler setting grooves 54, 55. Thus, the key rotor 51 is made freely rotatable with respect to the sleeve 47. As a result, as the inserted regular key 41 is rotated, the key rotor 51 is rotated with respect to the sleeve 47 and hence the rotor case 42, which in turn rotates the lock lever 124 that is engaged with the key rotor 51 through the coupling member 127 integrally, thereby allowing the cylinder lock to be unlocked.

At this instance, the range of rotation of the key rotor 51 and the lock lever 124 is regulated by the retaining projection 129 of the coupling member 127 being abutted against the retaining portions 45*a*, 45*a* of the rotor case 42. In addition, since the sleeve 47 does not rotate even if the key rotor 51, the coupling member 127, and the lock lever 124 are rotated within such range, the moving member 122 remains held in the coupling position.

Further, if a key other than the regular key, e.g., a wrong key 75, is inserted into the keyhole 53 to forcibly rotate the key rotor 51 under the aforementioned pre-insertion condition, at least some of the tumblers 56, 57 are brought into engagement with the tumbler engagement groove 48. As a result, the key rotor 51 and the sleeve 47 are rotated integrally with each other (see FIGS. 43 to 46).

When the sleeve 47 rotates, the moving member 122 is moved to the uncoupling position, which is down, by the slopes of the cam portion 49 arranged in the sleeve 47 (see an arrow D1 in FIGS. 43 and 45) and, in association therewith, the coupling member 127 is moved to the disengagement position, which is down (see the arrow D1 in FIG. 44), disengaging the engagement projection 130 of the coupling member 127 from the coupling member engagement recess 121 of the key rotor 51. Further, when the sleeve 47 is rotated with respect to the rotor case 42, the moving block 71 is moved toward the key rotor 51 by the slopes of the original position engagement recess 46 (see an arrow D2 in FIGS. 45 and 46), which disengages the moving block 71 from the rotor case 42 and in turn engages the moving block 71 with the engagement recess 61 of the key rotor 51.

Therefore, in this case, the key rotor 51 and the sleeve 47 rotate integrally with each other, but the lock lever 124 is not rotated. Thus, the cylinder lock is not unlocked. That is, even if the key rotor is forcibly rotated by a wrong key or the like, the key rotor 51 and the sleeve 47 only rotate idly, which neither unlocks the cylinder lock nor gives any damaging force to the components thereof, thereby excluding the possibility of the components being broken and allowing the cylinder lock to be used again.

By the way, in the fourth embodiment also, when the wrong key 75 is released with the key rotor 51 and the sleeve 47 having been rotated to an arbitrary position from the original position, the key rotor 51 and the sleeve 47 may, in some cases, be out of the original position.

In such a case, in a manner similar to that in the second embodiment, when the regular key 41 is inserted into the keyhole 53, the respective tumblers 56, 57 are moved so as to be set in the tumbler setting grooves 54, 55, so that the tumblers 56, 57 are disengaged from the sleeve 47. However, the moving block 71 is engaged so as to bridge between the sleeve 47 and the key rotor 51. Therefore, when the key rotor 51 is rotated by the regular key 41, the sleeve 47 is also rotated integrally with the key rotor 51. When the key rotor 51 and the sleeve 47 are rotated as far as to the original position, the first engagement portion 73 of the moving block 71 confronts the original position engagement recess 46 of the rotor case 42 and is thereby engaged therewith (see FIGS. 40 and 41). As a result, the key rotor 51 and the sleeve 47 come to be held in the original position.

The cylinder lock according to the fourth embodiment such as described above can provide not only advantages similar to those of the second embodiment, but also the following advantages. Since not only the retaining piece 126 of the lock lever 124 is fitted with the fitting cylinder portion 128 of the coupling member 127 but also the engagement projection 130 of the coupling member 127 is engaged with the coupling member engagement recess 121 of the key rotor 51, a sufficiently large margin is given for the engagement of the engagement projection 130 with the coupling member engagement recess 121 in the axial direction, which in turn ensures sufficient mechanical strength for these engagement portions.

Incidentally, in the case of the second embodiment, the projection 68 arranged on the fitting hole 67 portion of the lock lever 65 is engaged with the lock lever engagement recess 60 arranged on the shaft portion 59 of the key rotor 51. Therefore, only a margin as much as the thickness of the lock lever 65 can be provided for the engagement of the projection 68 in the axial direction, which thus makes it difficult to ensure a sufficient strength of the projection 68.

The cylinder locks according to the present invention are provided as only rotating the key rotor and the sleeve idly and not rotating the lock lever even if a key other than the regular key, a screwdriver, or the like is inserted thereinto to forcibly rotate the key rotor. Therefore, not only the cylinder locks cannot be unlocked, but also no damaging force is applied to the components thereof. Hence, the possibility of the components being broken is excluded and the cylinder locks can thereby be used again. In addition, the absence of axially moving members contributes to preventing the cylinder locks from growing in size in the axial direction.

The cylinder lock according to the present invention is provided as holding the sleeve in the original position by arranging the moving block in the sleeve and allowing the moving block to be engaged with the original position engagement recess of the rotor case, and as rotating the sleeve and the key rotor integrally with each other by causing the moving block to be engaged with the key rotor if the sleeve and the key rotor are rotated by a wrong key or the like. Therefore, the rotation of the sleeve can be prohibited at the time of regularly unlocking and locking the cylinder lock. In addition, the position of the sleeve and the key rotor can be identified.

What is claimed is:

1. A cylinder lock comprising:

a rotor case cylindrical in shade and fixedly arranged;

a sleeve rotatably arranged inside the rotor case and having tumbler engagement grooves therein;

a key rotor rotatably arranged inside the sleeve and having an axially extending keyhole and radially extending tumbler setting grooves thereon;

tumblers movably arranged in the tumbler setting grooves of the key rotor, the tumblers having ends engageable with the sleeve, the tumblers being held in the tumbler engagement grooves by spring members before a key is inserted, and being released from the tumbler engagement groves by insertion of a regular key;

a lock lever selectively rotatable with the key rotor; and a main coupling member for coupling the rotor case, the key rotor and the lock lever, wherein the key rotor includes a rear rotor rotatably arranged coaxially with the key rotor so as to confront the key rotor in an axial direction; and wherein the main coupling member includes:

a key rotor side coupling portion formed at a portion confronting the rear rotor in the key rotor;

a rear rotor side coupling portion formed at a portion confronting the key rotor in the rear rotor;

a coupling member movable in radial directions to bridge the key rotor side coupling portion and the rear rotor side coupling portion, being selectively set in an engagement position and in a disengagement position, and allowing the key rotor and the rear rotor to be rotatable integrally with each other in the engagement position before the key is inserted, the engagement position being a position at which the coupling member is engaged with the key rotor side coupling portion and the rear rotor side coupling portion in a rotational direction by movement thereof, the disengagement position corresponding to a position at which the engagement of the coupling member is released thereby making the rotor freely rotatable independent of the rear rotor; and an uncoupling mechanism having a moving element arranged in the rotor case so as to be movable in the radial directions by rotation of the sleeve to cause the coupling member to move to the disengagement position by movement of the moving element.

2. A cylinder lock comprising:

a rotor case cylindrical in shape and fixedly arranged;

a sleeve rotatably arranged inside the rotor case and having tumbler engagement grooves therein;

a key rotor rotatably arranged inside the sleeve and having an axially extending keyhole and radially extending tumbler setting grooves thereon;

tumblers movably arranged in the tumbler setting grooves of the key rotor, the tumblers having ends engageable with the sleeve, the tumblers being held in the tumbler engagement grooves by spring members before a key is inserted, and being released from the tumbler engagement grooves by insertion of a regular key;

a lock lever selectively rotatable with the key roto; and a main coupling member for coupling the rotor case, the key rotor and the lock lever, wherein the lock lever is arranged in a rear portion of the key rotor, being movable only radially between an engagement position at which the lock lever is engaged with the key rotor and a disengagement position at which the lock lever is disengaged from the key rotor; and wherein the main coupling member includes:

a moving member being movable in the radial directions between a coupling position and an uncoupling position while bridging the sleeve and the rotor case causing the lock lever to engage in the engagement position while allowing the lock lever to rotate when the moving member is in the coupling position, and causing the lock lever to move to the disengagement position while regulating the rotation of the lock lever when the moving member is in the uncoupling position, making the key rotor freely rotatable independent of the lock lever; and a cam portion arranged in the sleeve to move the moving member to the coupling position before the key is inserted, and to move the moving member to the uncoupling position as the sleeve is being rotated.

3. A cylinder lock comprising:

a rotor case cylindrical in shape and fixedly arranged;

a sleeve rotatably arranged inside the rotor case and having tumbler engagement grooves therein;

a key rotor rotatably arranged inside the sleeve and having an axially extending keyhole and radially extending tumbler setting grooves thereon;

tumblers movably arranged in the tumbler setting grooves of the key rotor, the tumblers having ends engageable with the sleeve, the tumblers being held in the tumbler engagement grooves by spring members before a key is inserted, and being released from the tumbler engagement grooves by insertion of a regular key;

a lock lever selectively rotatable with the key rotor; and a main coupling member for coupling the rotor case, the key rotor and the lock lever, wherein the lock lever is attached to a rear portion of the key rotor being movable in radial directions between an engagement position engaging the lock lever with the key rotor and a disengagement position disengaging the lock lever from the key rotor; and wherein the main coupling member includes:

a rear rotor surrounding the rear portion of the key rotor to be rotatable integrally with the key rotor, and to be movable with respect to the key rotor in the radial directions between a coupling position and an uncoupling position, causing the lock lever to move to the engagement position when the rear rotor is in the coupling position, and causing the lock lever to move to the disengagement position when the rear rotor is in the uncoupling position, making the key rotor freely rotatable independent of the lock lever and making the rear rotor rotatable with respect to the lock lever; and a cam portion arranged in a rear portion of the sleeve, causing the rear rotor to move to the uncoupling position before the key is inserted, and to move the rear rotor to the coupling position as the rear rotor is being rotated with respect to the sleeve.

4. A cylinder lock as claimed in claims 1, 2, or 3, further comprising:

an auxiliary coupling member including:

a moving block movable in the sleeve to pass through the sleeve in the radial direction and be urged toward the rotor case by a spring member;

an original position engagement recess in the rotor case, the original position engagement recess engageable with the moving block in the sleeve, said sleeve set in an original position before a key is inserted, and the original position engagement recess having slopes causing the moving block to move toward the key rotor while the sleeve is rotated from the original position; and an engagement recess arranged in the key rotor engageable with the moving block as the moving block is moved toward the key rotor.

* * * * *

UNITED STATES PATENT AND TRADEMARK OFFICE

CERTIFICATE OF CORRECTION

PATENT NO. : 5,577,409

DATED : November 26, 1996

INVENTOR(S) : Yoshinobu OYABU et al.

It is certified that error appears in the above-indentified patent and that said Letters Patent is hereby corrected as shown below:

Title page, item [57], in the Abstract, line 8, "never" should read --ever--.

* Claim 2, column 22, line 12, "roto;" should read --rotor--.

Signed and Sealed this

Twelfth Day of August, 1997

Bruce Lehman

*Attest:*

BRUCE LEHMAN

*Attesting Officer*

*Commissioner of Patents and Trademarks*